US008327955B2

(12) United States Patent
Patel

(10) Patent No.: US 8,327,955 B2
(45) Date of Patent: Dec. 11, 2012

(54) NON-PARALLEL FACE POLYCRYSTALLINE DIAMOND CUTTER AND DRILLING TOOLS SO EQUIPPED

(75) Inventor: Suresh G. Patel, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 522 days.

(21) Appl. No.: 12/493,640

(22) Filed: Jun. 29, 2009

(65) Prior Publication Data

US 2010/0326741 A1 Dec. 30, 2010

(51) Int. Cl.
*E21B 10/46* (2006.01)

(52) U.S. Cl. ..... 175/430; 175/431; 175/434

(58) Field of Classification Search ..... 175/428, 175/430, 431, 434
See application file for complete search history.

(56) References Cited

U.S. PATENT DOCUMENTS

| | | | | |
|---|---|---|---|---|
| 734,515 | A | 7/1903 | Collins | |
| 1,650,492 | A | 11/1927 | Coaton | |
| 2,641,446 | A | 6/1953 | Haglund et al. | |
| 2,707,897 | A | 5/1955 | Beeson | |
| 2,735,656 | A | 2/1956 | Hoglund et al. | |
| 2,777,672 | A | 1/1957 | Haglund et al. | |
| 2,842,342 | A | 7/1958 | Haglund | |
| 2,888,247 | A | 5/1959 | Haglund | |
| 3,388,757 | A | 6/1968 | Fittinger | |
| 3,745,623 | A | 7/1973 | Wentorf, Jr. et al. | |
| 4,200,159 | A | 4/1980 | Peschel et al. | |
| 4,512,426 | A | 4/1985 | Bidegaray | |
| 4,545,441 | A | 10/1985 | Williamson | |
| 4,552,232 | A | 11/1985 | Frear | |
| 4,593,777 | A * | 6/1986 | Barr | 175/379 |
| 4,640,375 | A | 2/1987 | Barr et al. | |
| 4,686,080 | A | 8/1987 | Hara et al. | |
| 4,762,492 | A | 8/1988 | Nagai | |
| 4,858,707 | A | 8/1989 | Jones et al. | |
| 4,872,520 | A | 10/1989 | Nelson | |
| 4,984,642 | A | 1/1991 | Renard et al. | |
| 5,007,493 | A | 4/1991 | Coolidge et al. | |
| 5,145,017 | A | 9/1992 | Holster et al. | |
| 5,172,778 | A | 12/1992 | Tibbitts et al. | |
| 5,279,375 | A | 1/1994 | Tibbitts et al. | |
| 5,314,033 | A | 5/1994 | Tibbitts | |
| 5,332,051 | A | 7/1994 | Knowlton | |
| 5,333,699 | A | 8/1994 | Thigpen et al. | |
| 5,351,772 | A | 10/1994 | Smith | |
| 5,377,773 | A | 1/1995 | Tibbitts | |

(Continued)

FOREIGN PATENT DOCUMENTS

EP 0117506 A2 9/1984

(Continued)

OTHER PUBLICATIONS

International Search Report for International Application No. PCT/US2010/044315 mailed Mar. 23, 2011, 3 pages.

(Continued)

*Primary Examiner* — Jennifer H Gay
(74) *Attorney, Agent, or Firm* — TraskBritt

(57) ABSTRACT

A superabrasive cutter including a superabrasive table having a cutting face in non-perpendicular orientation with respect to a longitudinal axis of the cutter. A superabrasive cutter having a cutting face of a superabrasive table in non-parallel orientation to a back surface thereof.

8 Claims, 11 Drawing Sheets

U.S. PATENT DOCUMENTS 5,379,854 A 1/1995 Dennis
5,437,343 A 8/1995 Cooley et al.
5,447,208 A 9/1995 Lund et al.
5,449,048 A 9/1995 Thigpen et al.
5,460,233 A 10/1995 Meany et al.
5,486,137 A 1/1996 Flood et al.
5,558,170 A 9/1996 Thigpen et al.
5,655,612 A 8/1997 Grimes et al.
5,667,028 A 9/1997 Truax et al.
5,706,906 A 1/1998 Jurewicz et al.
5,778,994 A 7/1998 Spatz
5,848,657 A 12/1998 Flood et al.
5,881,830 A * 3/1999 Cooley ..... 175/428
5,944,129 A 8/1999 Jensen
5,957,228 A 9/1999 Yorston et al.
5,979,577 A 11/1999 Fielder
5,979,578 A 11/1999 Packer
5,996,713 A 12/1999 Pessier et al.
6,000,483 A 12/1999 Jurewicz et al.
6,011,232 A 1/2000 Matthias
6,045,440 A 4/2000 Johnson et al.
6,050,354 A 4/2000 Pessier et al.
6,053,263 A 4/2000 Meiners
6,065,554 A 5/2000 Taylor et al.
6,068,071 A 5/2000 Jurewicz
6,082,474 A 7/2000 Matthias
6,145,608 A 11/2000 Lund et al.
6,164,394 A 12/2000 Mensa-Wilmot et al.
6,167,975 B1 1/2001 Estes
6,196,340 B1 3/2001 Jensen et al.
6,202,770 B1 3/2001 Jurewicz et al.
6,230,828 B1 5/2001 Beuershausen et al.
6,241,034 B1 6/2001 Steinke et al.
6,241,035 B1 6/2001 Portwood
6,269,894 B1 8/2001 Griffin
6,272,753 B2 8/2001 Packer
6,315,067 B1 11/2001 Fielder
6,315,652 B1 11/2001 Snyder et al.
6,394,199 B1 5/2002 Skyles et al.
6,443,248 B2 9/2002 Yong et al.
6,447,560 B2 9/2002 Jensen et al.
6,513,608 B2 2/2003 Eyre et al.
6,527,069 B1 3/2003 Meiners et al.
6,564,886 B1 5/2003 Mensa-Wilmot et al.
6,601,662 B2 8/2003 Matthias et al.
6,672,406 B2 1/2004 Beuershausen
6,739,417 B2 5/2004 Smith et al.
6,810,972 B2 11/2004 Sved
6,810,973 B2 11/2004 Sved
6,814,168 B2 11/2004 Sved
6,827,159 B2 12/2004 Sved
6,904,983 B2 6/2005 Thigpen et al.
6,935,444 B2 8/2005 Lund et al.
6,986,297 B2 1/2006 Scott
7,316,279 B2 1/2008 Wiseman et al.
7,517,589 B2 * 4/2009 Eyre ..... 428/408
7,608,333 B2 * 10/2009 Eyre ..... 428/408
7,740,673 B2 * 6/2010 Eyre ..... 51/309
7,754,333 B2 * 7/2010 Eyre et al. ..... 428/408
7,762,359 B1 7/2010 Miess
7,942,218 B2 5/2011 Cooley et al.
7,946,363 B2 5/2011 Zhang et al.
2001/0003932 A1 6/2001 Packer
2003/0116361 A1 6/2003 Smith et al.
2004/0049193 A1 3/2004 Capanni
2004/0149493 A1 8/2004 McDonough
2004/0149495 A1 8/2004 Thigpen et al.
2004/0163851 A1 8/2004 McDonough et al.
2005/0137598 A1 6/2005 Auth
2005/0247492 A1 11/2005 Shen et al.
2005/0269139 A1 12/2005 Shen et al.
2007/0181348 A1 8/2007 Lancaster et al.
2008/0035387 A1 2/2008 Hall et al.
2008/0156544 A1 7/2008 Singh et al.
2008/0236900 A1 10/2008 Cooley et al.
2010/0307829 A1 12/2010 Patel
2010/0326741 A1 * 12/2010 Patel ..... 175/431

FOREIGN PATENT DOCUMENTS

EP 0117552 A2 9/1984
EP 0189212 A1 7/1986
EP 0236924 A2 9/1987
EP 0542237 A1 5/1993
EP 0852283 A2 7/1998
EP 0918135 A1 5/1999
GB 2344607 A 11/1999
GB 2373522 A 9/2002
GB 2378202 A 2/2003
GB 2378721 A 2/2003
WO 9708420 A1 3/1997
WO 9735091 A1 9/1997

OTHER PUBLICATIONS

International Written Opinion for International Application No. PCT/US2010/044315 mailed Mar. 23, 2011, 4 pages.
International Preliminary Report on Patentability for International Application No. PCT/US2010/044315 dated, Feb. 7, 2012.

* cited by examiner

NON-PARALLEL FACE POLYCRYSTALLINE DIAMOND CUTTER AND DRILLING TOOLS SO EQUIPPED

CROSS-REFERENCE TO RELATED APPLICATION

The subject matter of the present application is related to U.S. application Ser. No. 12/537,750, filed Aug. 7, 2009, pending.

TECHNICAL FIELD

This invention relates to devices used in drilling and boring through subterranean formations. More particularly, this invention relates to a polycrystalline diamond or other superabrasive cutter intended to be installed on a drill bit or other tool used for earth or rock boring, such as may occur in the drilling or enlarging of an oil, gas, geothermal or other subterranean borehole, and to bits and tools so equipped that include cooperative combinations of positive and neutral or negative rake cutters.

BACKGROUND

There are three types of bits that are generally used to drill through subterranean formations. These bit types are: (a) percussion bits (also called impact bits); (b) rolling cone bits, including tri-cone bits; and (c) drag bits or fixed cutter rotary bits (including core bits so configured), the majority of which currently employ diamond or other superabrasive cutters, polycrystalline diamond compact (PDC) cutters being most prevalent. There also exist so-called "hybrid" bits, which include both fixed cutters and rolling cones or other rolling cutting components.

In addition, there are other structures employed downhole, generically termed "tools" herein, which are employed to cut or enlarge a borehole or which may employ superabrasive cutters, inserts or plugs on the surface thereof as cutters or wear-prevention elements. Such tools might include, merely by way of example, reamers, stabilizers, tool joints, wear knots and steering tools. There are also formation cutting tools employed in subterranean mining, such as drills and boring tools.

Percussion bits are used with boring apparatus known in the art that moves through a geologic formation by a series of successive impacts against the formation, causing a breaking and loosening of the material of the formation. It is expected that the cutter of the invention will have use in the field of percussion bits.

Bits referred to in the art as rock bits, tri-cone bits or rolling cone bits (hereinafter "rolling cone bits") are used to bore through a variety of geologic formations, and demonstrate high efficiency in firmer rock types. Prior art rolling cone bits tend to be somewhat less expensive than PDC drag bits, with limited performance in comparison. However, they have good durability in many hard-to-drill formations. An exemplary prior art rolling cone bit is shown in FIG. 2. A typical rolling cone bit operates by the use of three rotatable cones oriented substantially transversely to the bit axis in a triangular arrangement, with the narrow cone ends facing a point in the center of the triangle that they form. The cones have cutters formed or placed on their surfaces. Rolling of the cones in use due to rotation of the bit about its axis causes the cutters to imbed into hard rock formations and remove formation material by a crushing action. Prior art rolling cone bits may achieve a rate of penetration (ROP) through a hard rock formation ranging from less than one foot per hour up to about thirty feet per hour. It is expected that the cutter of the invention will have use in the field of rolling cone bits as a cone insert for a rolling cone, as a gage cutter or trimmer, and on wear pads on the gage.

A third type of bit used in the prior art is a drag bit or fixed-cutter bit. An exemplary drag bit is shown in FIG. 1. The drag bit of FIG. 1 is designed to be turned in a clockwise direction (looking downward at a bit being used in a hole, or counterclockwise if looking at the bit from its cutting end as shown in FIG. 1) about its longitudinal axis. The majority of current drag bit designs employ diamond cutters comprising polycrystalline diamond compacts (PDCs) mounted to a substrate, typically of cemented tungsten carbide (WC). State-of-the-art drag bits may achieve an ROP ranging from about one to in excess of one thousand feet per hour. A disadvantage of state-of-the-art PDC drag bits is that they may prematurely wear due to impact failure of the PDC cutters, as such cutters may be damaged very quickly if used in highly stressed or tougher formations composed of limestones, dolomites, anhydrites, cemented sandstones interbedded formations such as shale with sequences of sandstone, limestone and dolomites, or formations containing hard "stringers." It is expected that the cutter of the invention will have use in the field of drag bits as a cutter, as a gage cutter or trimmer, and on wear pads on the gage.

As noted above, there are additional categories of structures or "tools" employed in boreholes, which tools employ superabrasive elements for cutting or wear prevention purposes, including reamers, stabilizers, tool joints, wear knots and steering tools. It is expected that the cutter of the present invention will have use in the field of such downhole tools for such purposes, as well as in drilling and boring tools employed in subterranean mining.

It has been known in the art for many years that PDC cutters perform well on drag bits. A PDC cutter typically has a diamond layer or table formed under high temperature and pressure conditions to a cemented carbide substrate (such as cemented tungsten carbide) containing a metal binder or catalyst such as cobalt. The substrate may be brazed or otherwise joined to an attachment member such as a stud or to a cylindrical backing element to enhance its affixation to the bit face. The cutting element may be mounted to a drill bit either by press-fitting or otherwise locking the stud into a receptacle on a steel-body drag bit, or by brazing the cutter substrate (with or without cylindrical backing) directly into a preformed pocket, socket or other receptacle on the face of a bit body, as on a matrix-type bit formed of WC particles cast in a solidified, usually copper-based, binder as known in the art.

A PDC is normally fabricated by placing a disk-shaped cemented carbide substrate into a container or cartridge with a layer of diamond crystals or grains loaded into the cartridge adjacent one face of the substrate. A number of such cartridges are typically loaded into an ultra-high pressure press. The substrates and adjacent diamond crystal layers are then compressed under ultra-high temperature and pressure conditions. The ultra-high pressure and temperature conditions cause the metal binder from the substrate body to become liquid and sweep from the region behind the substrate face next to the diamond layer through the diamond grains and act as a reactive liquid phase to promote a sintering of the diamond grains to faun the polycrystalline diamond structure. As a result, the diamond grains become mutually bonded to form a diamond table over the substrate face, which diamond table is also bonded to the substrate face. The metal binder may remain in the diamond layer within the pores existing between the diamond grains or may be removed and optionally replaced by another material, as known in the art, to form a so-called thermally stable diamond ("TSD"). The binder is removed by leaching or the diamond table is formed with silicon, a material having a coefficient of thermal expansion (CTE) similar to that of diamond. Variations of this general process exist in the art, but this detail is provided so that the reader will understand the concept of sintering a diamond layer onto a substrate in order to form a PDC cutter. For more background information concerning processes used to form polycrystalline diamond cutters, the reader is directed to U.S. Pat. No. 3,745,623, issued on Jul. 17, 1973, in the name of Wentorf, Jr. et al.

Conventional rotary drill bits using polycrystalline diamond compacts (PDCs) disposed on the bit face in order to produce shearing forces in the formation to be cut. Typically, these cutters are angularly positioned on the face of the drill bit according to the formation material that they are designed to cut.

In drag bits, such as illustrated in FIG. 1, positive rake cutters have an angle of inclination in the direction of bit rotation of greater than 90°. That is, positive rake cutters lean forward, or lean in the direction of bit rotation, with the included angle between the cutter face and the formation in front of it is greater than 90°. Such positive rake cutters tend to dig into the formation material, as they do not put additional compressional stresses in formation, which would give it a higher effective strength. The rotation and weight on the drill bit encourages such positive rake cutters to cut into the formation to their fully exposed depth, which could risk stalling of the bit. However, the hardness of the formation material may resist full depth penetration by a positive rake cutter. Therefore, in relatively hard material a positive rake cutter will typically not invade the formation material to its full depth, although stalling of the drill bit may still be a problem.

Conversely, a drill bit having positive rake cutters used in a formation having greater plasticity will likely result in full depth penetration of the positive rake cutters, resulting in the drill bit requiring more torque to turn the drill bit and causing the bit to stall. Accordingly, drill bits designed primarily for use in formations having greater plasticity typically use cutters having a negative rake.

The face of a negative rake cutter has an angle of inclination or included angle relative to the formation that is less than 90°, or opposite to that of a positive rake cutter. In use, a negative rake cutter has a tendency to ride along the surface of the formation giving the cutter a higher effective strength and more plasticity, resisting entry into the formation for making a shallow cut as a result of the weight on the drill bit. While negative rake cutters resist stalling of the drill bit in plastic formations because of lower aggressiveness, the linear rate of cut for a drill bit having negative rake cutters is typically less than that of the rate of cut for a bit having positive rake cutters.

Referring to FIG. 3 of the drawings, it should be noted that, while the angle of inclination of a cutting surface relative to a formation 18 is determinative of whether a particular cutter is classified as positive or negative rake cutters, the contact between the formation 18 and a cutter does not occur on a horizontal path. Rather, since a drill bit is rotating and moving downward into the formation as the borehole is cut, the cutting path followed by an individual cutter on the surface of the bit follows a helical path, as conceptually shown with respect to bit 10 depicted in FIG. 3. Bit 10 is illustrated having a longitudinal axis or centerline 24 that coincides with and extends into the longitudinal axis of a borehole 26. For illustrative purposes, bit 10 is shown having a single cutter 28 affixed on the exterior surface of the drill bit 10. It should be understood that a bit typically employs numerous cutters, but for the purposes of illustrating the helical path followed by an individual cutter on bit 10, as well as the effective rake angle of an individual cutter, only a single cutter 28 has been illustrated. The helical cutting path traveled by the cutter 28 is illustrated by solid line 30 extending the borehole 26 into formation 18.

The lone cutter 28 may have what would appear to be a negative rake angle relative to the horizontal surface 19' of the formation 18. The angle θ formed between the horizontal and the planar cutting surface 29 of the cutter 28 is less than 90°. However, since bit 10 produces a downward linear motion as it drills the borehole 26, the effective path followed by the cutter 28 is generally downward at an angle of inclination related to the drilling rate of bit 10.

For example, a bit 10 having a cutter 28 rotating in a radius of six inches, at a drilling rate of ten feet per minute, and a rotational speed of 50 revolutions per minute results in the helical path 30 having an angle of inclination relative to horizontal of approximately 4°. Accordingly, if the cutting surface 29 of cutter 28 has an apparent angle of inclination relative to horizontal of approximately 86° (4° negative rake, relative to horizontal), then the cutting surface 29 has an effective angle of inclination, or effective rake, of precisely 90° and will be neither negatively nor positively raked. Such a rake angle may be termed a "neutral" rake or rake angle.

It should be recognized that the radial position of the cutter 28 is determinative as to the effective rake angle. For example, if the cutter 28 is positioned on the surface of the drill bit 10 at a radial distance of only three inches from the center, then its path has an angle of inclination relative to the horizontal of approximately 7°. The closer a cutter is positioned to the bit center, the greater the angle of inclination relative to the horizontal for a given rotational speed and given actual rake, and the greater the apparent negative rake of the cutter must be to obtain an effective negative rake angle.

In order to properly locate and orient cutter 28 and cutting surface 29 to have an effective positive, neutral or negative rake, it is desirable to estimate performance characteristics of the drill bit 10, as well as to determine the radial position of the cutter 28. For example, assuming that the cutter 28 is radially located six inches from the bit centerline and cutting surface 29 is inclined at an angle of 88° (2° negative rake relative to horizontal) and the drill bit 10 is being designed to achieve the drilling rate and rotational speed characteristics discussed immediately above, such that the helical path is inclined at an angle of 4°, then the effective rake angle of the cutting surface 29 is 92° (88°+4°=92°=2° positive rake). Thus, while the apparent angle of inclination or rake angle of the cutting surface 29 appears to be negative, the effective rake angle is actually positive. Such a design methodology would, of course, be performed for each cutter on a drill bit. It should be noted that not all boreholes have a vertical longitudinal axis. Therefore, it is appropriate to refer to the apparent angle of inclination as the angle formed between the planar cutting surface and a plane perpendicular to the longitudinal axis 24 of the bit. The "effective rake angle," on the other hand, refers to the effective angle of inclination when the rotational speed and rate of penetration of bit 10 are taken into account. Accordingly, with the "effective rake angle" the angles of inclination of the cutting surface of drill bit cutters described hereinafter are measured and characterized as positive, negative or neutral relative to the intended helical cutting path 30 and not relative to horizontal (unless otherwise noted).

Referring now particularly to FIG. 4, therein is depicted a side elevation of a portion of a drill bit 10 with a positive rake cutter 12 and a negative rake cutter 14 affixed thereto. As noted above with respect to FIG. 3, the terms "positive" and "negative" rake are employed with reference to the effective angle between the cutting surface and the formation. The cutters 12 and 14 are secured in the bit body 16 in a conventional manner, such as by being furnaced therewith in the body of a metal matrix type bit, attached to a bit body via studs, or brazed or otherwise attached to the bit body 16. It should be understood that the present invention is applicable to any type of drill bit body, including matrix, steel and combinations thereof, the latter including without limitation the use of a solid metal (such as steel) core with matrix blades, or a matrix core with hardfaced, solid metal blades. Stated another way, the present invention is not limited to any particular type of bit design or materials. In FIG. 3, the positive rake cutter 12 and the negative rake cutter 14 are illustrated removing formation material 18 in response to movement of the bit body 16 (and therefore cutters 12, 14), in a direction as indicated by arrow 21. The formation material 18 is in a plastic stress state and may be thought of as a flowing type material.

Cutters 12, 14 each preferably includes a generally planar cutting surface 20, 22. These cutting surfaces 20, 22 can be any of a variety of shapes known in the art. For the illustrated example, they may be considered as being of a conventional circular or disc shape. Cutting surfaces 20, 22 are preferably formed of a hard material, such as diamond or tungsten carbide, to resist wearing of the cutting surfaces caused by severe contact with the formation 18. In a particularly preferred embodiment, these cutting faces will each be formed of a diamond table, such as a single synthetic polycrystalline diamond PDC layer (including thermally stable PDC), a mosaic surface composed of a group of PDCs, or even a diamond film deposited by chemical vapor deposition techniques known in the art.

The angle of inclination of the cutting surfaces 20, 22 relative to the formation 18 is defined as positive or negative according to whether the angle formed therebetween is greater than or less than 90°, respectively, relative to the direction of cutter travel. For example, the cutting surface 20 of positive rake cutter 12 is illustrated having an angle of inclination or included angle $\propto$ relative to the formation of greater than 90°. That is to say, the bit face end or edge of planar cutting surface 20 leans away from the formation 18 with the leading edge of the cutting surface 20 contacting the formation 18. This positive rake of the cutting surface 20 encourages the cutter 12 to "dig in" to the formation 18 until the bit body 16 contacts the formation 18.

In contra-distinction thereto, the negative rake angle of cutting surface 22 of cutter 14 has an angle of inclination or included angle $\beta$ relative to the formation that is less than 90° relative to the formation 18. The lower circumferential cutting edge of the cutting surface 22 engaging formation 18 trails the remaining portion of the cutting surface 22, such that the cutter 14 has a tendency to ride along the surface of the formation 18, making only a shallow cut therein. The cutting action caused by the cutter 14 is induced primarily by the weight on bit 10. Cutting surface 22 may also be oriented substantially perpendicularly to formation 18, thus being at a "neutral" rake, or at 0° backrake. In such an instance, cutting surface 22 will engage the formation 18 in a cutting capacity but will also ride on the formation, as is the case with negative rake cutters. It is believed that enhanced side rake of such a cutter will increase its cutting action by promoting clearance of formation cuttings from the cutter face.

The combined use of positive and negative or neutral rake cutters has a balancing effect that results in the positive rake cutter producing a shallower cut than it would otherwise do absent the negative or neutral rake cutter 14. Similarly, the negative or neutral rake cutter 14 produces a deeper cut than it would otherwise do absent the positive rake cutter 12. For example, while the positive rake cutter 12 encourages the drill bit 10 to be pulled into the formation 18, the negative or neutral rake cutter 14 urges the drill bit 10 to ride along the surface. Therefore, the combined effect of the positive and negative or neutral rake cutters 12, 14 is to allow a bit 10 to produce cuts at a depth somewhere between the full and minimal depth cuts which could be otherwise urged by the positive and negative rake cutters individually. It should be noted that the rake of positive rake cutter 12 may be more radical or significant in the present invention than might be expected or even possible without the cooperative arrangement of cutters 12 and 14, in order to aggressively initiate the cut into formation 18, rather than "riding" or "skating" thereon, and to cut without stalling, even in softer formations.

It has also recently been recognized that formation hardness has a profound affect on the performance of drill bits as measured by the ROP through the particular formation being drilled by a given drill bit. Furthermore, cutters installed in the face of a drill bit so as to have their respective cutting faces oriented at a given rake angle will likely produce ROPs that vary as a function of formation hardness. That is, if the cutters of a given bit are positioned so that their respective cutting faces are oriented with respect to a line perpendicular to the formation, as taken in the direction of intended bit rotation, so as to have a relatively large back (negative) rake angle, such cutters would be regarded as having relatively nonaggressive cutting action with respect to engaging and removing formation material at a given WOB. Contrastingly, cutters having their respective cutting faces oriented so as to have a relatively small back (negative) rake angle, a zero rake angle, or a positive rake angle would be regarded as having relatively aggressive cutting action at a given WOB with a cutting face having a positive rake angle being considered most aggressive and a cutting face having a small back rake angle being considered aggressive but less aggressive than a cutting face having a zero back rake angle and even less aggressive than a cutting face having a positive back rake angle.

It has further been observed that when drilling relatively hard formations, such as limestones, sandstones, and other consolidated formations, bits having cutters that provide relatively nonaggressive cutting action decrease the amount of unwanted reactive torque and provide improved tool face control, especially when engaged in directional drilling. Furthermore, if the particular formation being drilled is relatively soft, such as unconsolidated sand and other unconsolidated formations, such relatively nonaggressive cutters, due to the large depth-of-cut (DOC) afforded by drilling in soft formations, result in a desirable, relatively high ROP at a given WOB. However, such relatively nonaggressive cutters when encountering a relative hard formation, which it is very common to repeatedly encounter both soft and hard formations when drilling a single borehole, will experience a decreased ROP with the ROP generally becoming low in proportion to the hardness of the formation. That is, when using bits having nonaggressive cutters, the ROP generally tends to decrease as the formation becomes harder and increase as the formation becomes softer because the relatively nonaggressive cutting faces simply cannot "bite" into the formation at a substantial DOC to sufficiently engage and efficiently remove hard formation material at a practical ROP. That is, drilling through relative hard formations with nonaggressive cutting faces simply takes too much time.

Contrastingly, cutters that provide relatively aggressive cutting action excel at engaging and efficiently removing hard formation material, as the cutters generally tend to aggressively engage, or "bite," into hard formation material. Thus, when using bits having aggressive cutters, the bit will often deliver a favorably high ROP, taking into consideration the hardness of the formation, and generally the harder the formation, the more desirable it is to have yet more aggressive cutters to better contend with the harder formations and to achieve a practical, feasible ROP therethrough.

It would be very helpful to the oil and gas industry, in particular, when using drag bits to drill boreholes through formations of varying degrees of hardness if drillers did not have to rely upon one drill bit designed specifically for hard formations, such as, but not limited to, consolidated sandstones and limestones and to rely upon another drill bit designed specifically for soft formations, such as, but not limited to, unconsolidated sands. That is, drillers frequently have to remove from the borehole, or trip out, a drill bit having cutters that excel at providing a high ROP in hard formations upon encountering a soft formation, or a soft "stringer," in order to exchange the hard-formation drill bit with a soft formation drill bit, or vice versa, when encountering a hard formation, or hard "stringer," when drilling primarily in soft formations.

Furthermore, it would be very helpful to the industry when conducting subterranean drilling operations and especially when conducting directional drilling operations, if methods were available for drilling which would allow a single drill bit be used in both relatively hard and relatively soft formations. Such a drill bit would thereby prevent an unwanted and expensive interruption of the drilling process to exchange formation-specific drill bits when drilling a borehole through both soft and hard formations. Such helpful drilling methods, if available, would result in providing a high, or at least an acceptable, ROP for the borehole being drilled through a variety of formations of varying hardness.

It would further be helpful to the industry to be provided with methods of drilling subterranean formations in which the cutting elements provided on a drag-type drill bit, for example, are able to efficiently engage the formation at an appropriate DOC suitable for the relative hardness of the particular formation being drilled at a given WOB, even if the WOB is in excess of what would be considered optimal for the ROP at that point in time. For example, if a drill bit provided with cutters having relatively aggressive cutting faces is drilling a relatively hard formation at a selected WOB suitable for the ROP of the bit through the hard formation and suddenly "breaks through" the relatively hard formation into a relatively soft formation, the aggressive cutters will likely overengage the soft formation. That is, the aggressive cutters will engage the newly encountered soft formation at a large DOC as a result of both the aggressive nature of the cutters and the still-present high WOB that was initially applied to the bit in order to drill through the hard formation at a suitable ROP but which is now too high for the bit to optimally engage the softer formation. Thus, the drill bit will become bogged down in the soft formation and will generate a TOB that in extreme cases will rotationally stall the bit and/or damage the cutters, the bit, or the drill string. Should a bit stall upon such a breakthrough occurring the driller must back off, or retract, the bit which was working so well in the hard formation but which has now stalled in the soft formation so that the drill bit may be set into rotational motion again and slowly eased forward to recontact and engage the bottom of the borehole to continue drilling. Therefore, if the drilling industry had methods of drilling wherein a bit could engage both hard and soft formations without generating an excessive amount of TOB while transitioning between formations of differing hardness, drilling efficiency would be increased and costs associated with drilling a wellbore would be favorably decreased.

Moreover, the industry would further benefit from methods of drilling subterranean formations in which the cutting elements provided on a drag bit are able to efficiently engage the formation so as to remove formation material at an optimum ROP yet not generate an excessive amount of unwanted TOB due to the cutting elements being too aggressive for the relative hardness of the particular formation being drilled.

SUMMARY OF THE INVENTION

A superabrasive cutter, for example a polycrystalline diamond cutter having a surface forming at least a portion of a cutting face on a diamond table in non-parallel orientation to a back surface thereof, or to an interface between the diamond table and a metal material supporting the diamond table.

A superabrasive cutter, for example of polycrystalline diamond cutter having a surface forming at least a portion of a cutting face on a diamond table in non-perpendicular orientation to a longitudinal axis of the cutter.

Drill bits equipped with embodiments of cutters of the invention.

Methods of making embodiments of cutters of the invention.

DETAILED DESCRIPTION OF THE PREFERRED EMBODIMENTS

Referring again to FIG. 1, an exemplary prior art drag bit is illustrated in distal end or face view. The drag bit 101 includes a plurality of cutters 102, 103 and 104 that may be arranged as shown in rows emanating generally radially from approximately the center of the bit 105. The inventor contemplates that the invented cutter will primarily be used on drag bits of any configuration.

Figure 2:
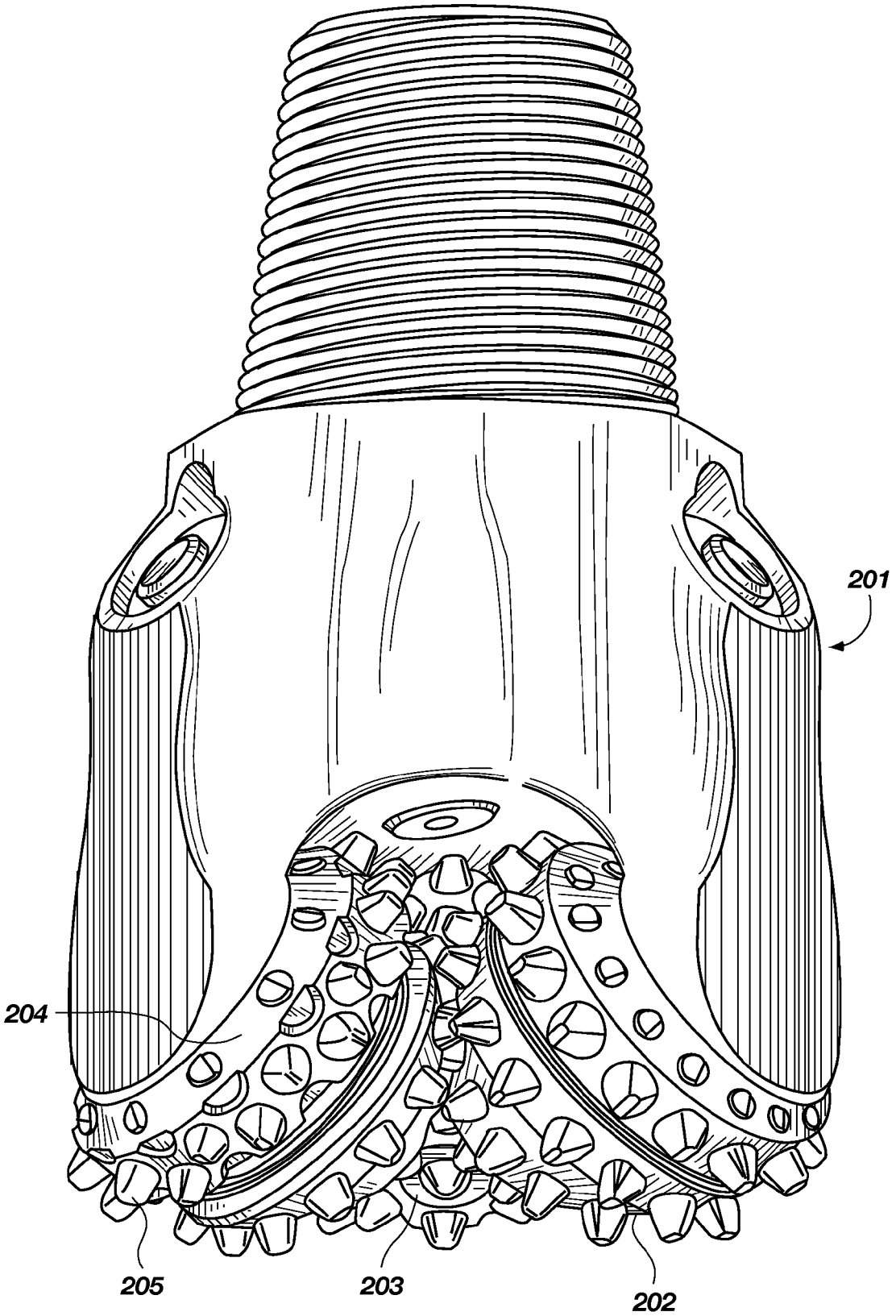
Fig. 2 (PRIOR ART)
FIG. 2 depicts a prior art roller cone bit.

In FIG. 2, an exemplary prior art roller cone bit is illustrated in side view. The roller cone bit 201 includes three rotatable cones 202, 203 and 204, each of which carries a plurality of cone inserts 205. The inventors contemplate that the invented cutter will also be used on roller cone bits of various configurations in the capacity of cone inserts, gage cutters and on wear pads.

Figure 5:
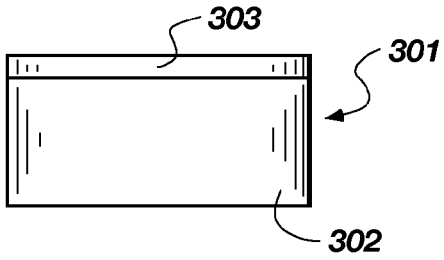
Fig. 5 (PRIOR ART)
FIG. 5 depicts a prior art diamond cutter.

FIG. 5 depicts a side view of a prior art polycrystalline diamond cutter typically used in drag bits. The cutter 301 is cylindrical in shape and has a substrate 302 that is typically made of cemented carbide such as tungsten carbide (WC) or other materials, depending on the application. The cutter 301 also has a sintered polycrystalline diamond table 303 formed onto substrate 302 by the manufacturing process mentioned above. Cutter 301 may be directly mounted to the face of a drag bit, or secured to a stud that is itself secured to the face of a bit.

Figure 3:
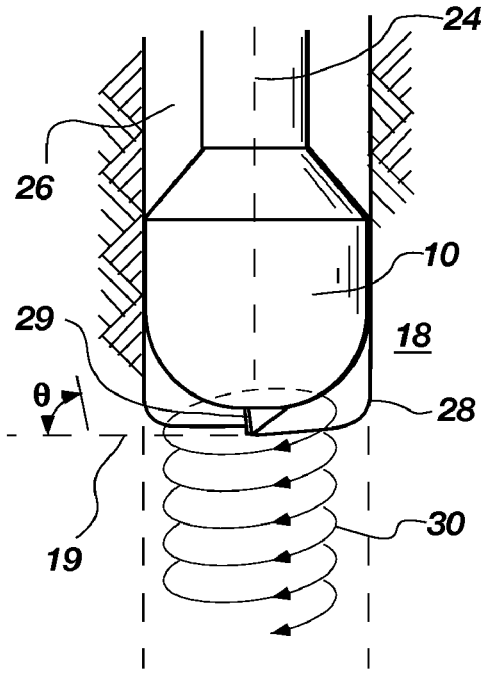
Fig. 3 (PRIOR ART)
FIG. 3 depicts a schematic side elevation of a drill bit with the helical cutting path of a selected cutter schematically depicted in relation thereto.
Figure 6:
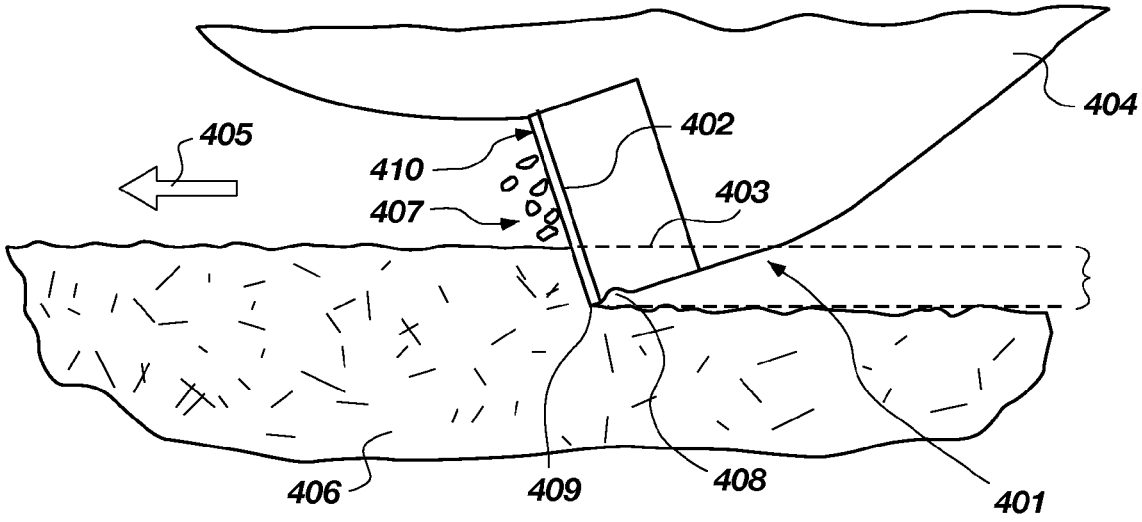
Fig. 6 (PRIOR ART)
FIG. 6 depicts a prior art diamond cutter in use.

FIG. 6 depicts a prior art diamond cutter 401, such as the type depicted in FIG. 3, in use on a bit. The cutter 401 has a disc-shaped PDC diamond layer or table 402, typically at 0.020 to 0.030 inch thickness (although as noted before, thicker tables have been attempted), sintered onto a tungsten carbide substrate 403. The cutter 401 is installed on a bit 404. As the bit 404 with cutter 401 move in the direction indicated by arrow 405, the cutter 401 engages rock 406, resulting in shearing of the rock 406 by the diamond table 402 and sheared rock 407 sliding along the cutting face 410 and away from the cutter 401. The reader should note that in plastic subterranean formations, the sheared rock 407 may be very long strips, while in non-plastic formations, the sheared rock 407 may comprise discrete particles, as shown. The cutting action of the cutter 401 results in a cut of depth "D" being made in the rock 406. It can also be seen from the figure that on the trailing side of the cutter 401 opposite the cut, both diamond layer 402 and substrate or stud 403 are present within the depth of cut D. This has several negative implications. It has been found that prior art cutters tend to experience abrasive and erosive wear on the substrate 403 within the depth of cut D behind the diamond layer or table 402 under certain cutting conditions. This wear is shown at reference numeral 408. Although it may sometimes be beneficial for this wear to occur because of the self-sharpening effect that it provides for the diamond table 402 (enhancing cutting efficiency and keeping weight on bit low), wear 408 causes support against bending stresses for the diamond layer 402 to be reduced, and the diamond layer 402 may prematurely spall, crack or break. This propensity to damage may be enhanced by the high unit stresses experienced at cutting edge 409 of cutting face 410.

Another problem is that the cutting face diamond layer 402, which is very hard but also very brittle, is supported within the depth of cut D not only by other diamond within the diamond layer 402, but also by a portion of the stud or substrate 403. The substrate is typically tungsten carbide and is of lower stiffness than the diamond layer 402. Consequently, when severe tangential forces are placed on the diamond layer 402 and the supporting substrate 403, the diamond layer 402, which is extremely weak in tension and takes very little strain to failure, tends to crack and break when the underlying substrate 403 flexes or otherwise "gives."

Figure 4:
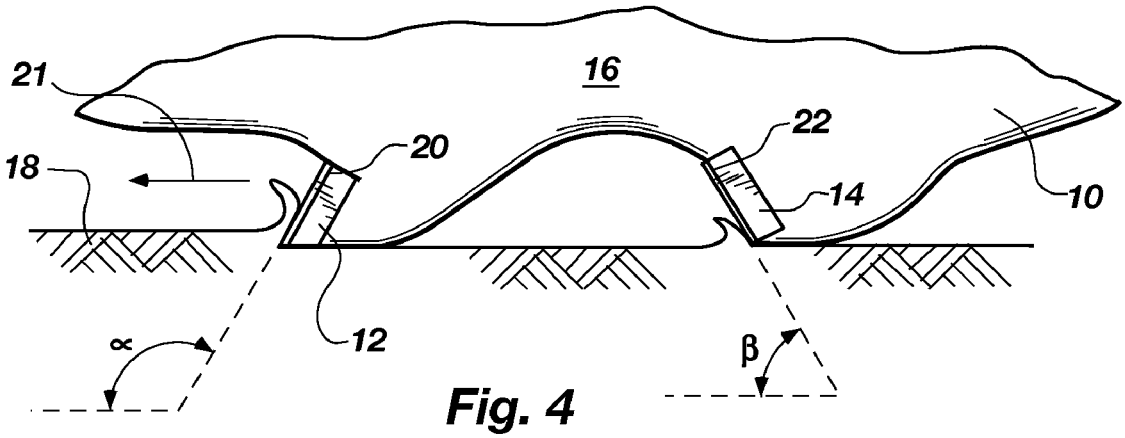
Fig. 4 (PRIOR ART)
FIG. 4 is a side elevation of a pair of positive and negative rake cutters positioned on a bit body surface.

Moreover, when use of a "double thick" (0.060 inch depth) diamond layer was attempted in the prior art, it was found that the thickened diamond layer 502 was also very susceptible to cracking, spalling and breaking. This is believed to be at least in part due to the magnitude, distribution and type (tensile, compressive) residual stresses (or lack thereof) imparted to the diamond table during the manufacturing process, although poor sintering of the diamond table may play a role. The diamond layer and carbide substrate have different thermal expansion coefficients and bulk moduli, which create detrimental residual stresses in the diamond layer and along the diamond/substrate interface. The "thickened" diamond table prior art cutter had substantial residual tensile stresses residing in the substrate immediately behind the cutting edge. Moreover, the diamond layer at the cutting edge was poorly supported, actually largely unsupported by the substrate as shown in FIG. 4, and thus possessed decreased resistance to tangential forces.

For another discussion of the deficiencies of prior art cutters as depicted in FIG. 6, the reader is directed to U.S. Pat. No. 5,460,233.

In a cutter configuration as in the prior art (see FIG. 6), it was eventually found that the depth of the diamond layer should be in the range of 0.020 to 0.030 inch for ease of manufacture and a perceived resistance to chipping and spalling. It was generally believed in the prior art that use of a diamond layer greater than 0.035 inch may result in a cutter highly susceptible to breakage, and may have a shorter service life.

Reference is made to FIGS. 7*a* through 7*d* which depict an end view, a side view, an enlarged side view and a perspective view, respectively, of an embodiment of a prior art cutter. The cutter 501 is of a shallow frustoconical configuration and includes a circular diamond layer or table 502 (e.g. polycrystalline diamond), a superabrasive material, having a back surface plane 502' bonded (i.e. sintered) to a cylindrical substrate 503 (e.g. tungsten carbide). The interface between the diamond layer and the substrate is, as shown, comprised of mutually parallel ridges separated by valleys, with the ridges and valleys extending laterally across cutter 501 from side to side. Of course, many other interface geometries are known in the art and suitable for use with the invention. The diamond layer 502 is of a thickness "$T_1$." The substrate 503 has a thickness "$T_2$." The diamond layer 502 includes rake land 508 with a rake land angle θ relative to the side wall 506 of the diamond layer 502 (parallel to the longitudinal axis or center line 507 of the cutter 501) and extending forwardly and radially inwardly toward the longitudinal axis 507. The rake land angle θ in the preferred embodiment is defined as the included acute angle between the surface of rake land 508 and the sidewall 506 of the diamond layer that, in the preferred embodiment, is parallel to longitudinal axis 507. It is preferred for the rake land angle θ to be in the range of 10° to 80°, but it is most preferred for the rake land angle θ to be in the range of 30° to 60°. However, it is believed to be possible to utilize rake land angles outside of this range and still produce an effective cutter that employs the structure of the invention.

The dimensions of the rake land are significant to performance of the cutter. The inventors have found that the width $W_1$ of the rake land 508 should be at least about 0.050 inch, measured from the inner boundary of the rake land (or the center of the cutting face, if the rake land extends thereto) to the cutting edge along or parallel to (e.g., at the same angle) to the actual surface of the rake land. The direction of measurement, if the cutting face is circular, is generally radial but at the same angle as the rake land. It may also be desirable that the width of the rake land (or height, looking head-on at a moving cutter mounted to a bit) be equal to or greater than the design DOC, although this is not a requirement of the invention.

Diamond layer 502 also includes a cutting face 513 having a flat central area 511 radially inward of rake land, and a cutting edge 509. The flat central area 511 of the cutting face 513 being parallel to the plane 502' of the diamond table 502. Between the cutting edge 509 and the substrate 503 resides a portion or depth of the diamond layer referred to as the base layer 510, while the portion or depth between the flat central area 511 of cutting face 513 and the base layer 510 is referred to as the rake land layer 512.

The central area 511 of cutting face 513, as depicted in FIGS. 7*a*, 7*b*, 7*c* and 7*d*, is a flat surface oriented perpendicular to longitudinal axis 507. In alternative embodiments of the invention, it is possible to have a convex cutting face area, such as that described in U.S. Pat. No. 5,332,051 to Knowlton. It is also possible to configure such that the land 508 surface of revolution defines a conical point at the center of the cutting face 513. However, the preferred embodiment of the invention is that depicted in FIGS. 7*a*-7*d*.

In the depicted cutter, the thickness $T_1$ of the diamond layer 502 is preferably in the range of 0.070 to 0.150 inch, with a most preferred range of 0.080 to 0.100 inch. This thickness results in a cutter that, in the invented configuration, has substantially improved impact resistance, abrasion resistance and erosion resistance.

In the exemplary preferred embodiment depicted, the base layer 510 thickness $T_3$ is approximately 0.050 inch as measured perpendicular to the supporting face of the substrate, parallel to axis 507. The rake land layer 512 is approximately 0.030 to 0.050 inch thick and the rake angle θ of the land 508 as shown is 65° but may vary. The boundary 515 of the diamond layer and substrate to the rear of the cutting edge should lie at least 0.015 inch longitudinally to the rear of the cutting edge and, in the embodiment of FIGS. 7*a*-7*d*, this distance is substantially greater. The diameter of the cutter 501 depicted is approximately 0.750 inch, and the thickness of the substrate 503 $T_2$ is approximately 0.235 to 0.215 inch, although these two dimensions are not critical.

As shown in FIGS. 7*a*-7*d*, the sidewall 517 of the cutter 501 is parallel to the longitudinal axis 507 of the cutter. Thus, as shown, angle θ equals angle Φ, the angle between rake land 508 and axis 507. However, cutters need not be circular or even symmetrical in cross-section, and the cutter sidewall may not always parallel the longitudinal axis of the cutter. Thus, the rake land angle may be set as angle θ or as angle Φ, depending upon cutter configuration and designer preference.

Another optional but desirable feature of the embodiment depicted in FIGS. 7*a* through 7*d* is the use of a low friction finish on the cutting face 513, including rake land 508. The preferred low friction finish is a polished mirror finish that has been found to reduce friction between the diamond layer 502 and the formation material being cut and to enhance the integrity of the cutting face surface, such as in U.S. Pat. No. 5,447,208 issued to Lund et al.

Yet another optional feature applicable to the embodiment of FIGS. 7*a* through 7*d* to a cutter is the use of a small peripheral chamfer or radius at the cutting edge as taught by the prior art to increase the durability of the cutting edge while running into the borehole and at the inception of drilling, at least along the portion which initially contacts the formation. The inventors have, to date, however, not been able to demonstrate the necessity for such a feature in testing. Alternately, the cutting edge may also be optionally honed in lieu of radiusing or chamfering.

Figure 7A:
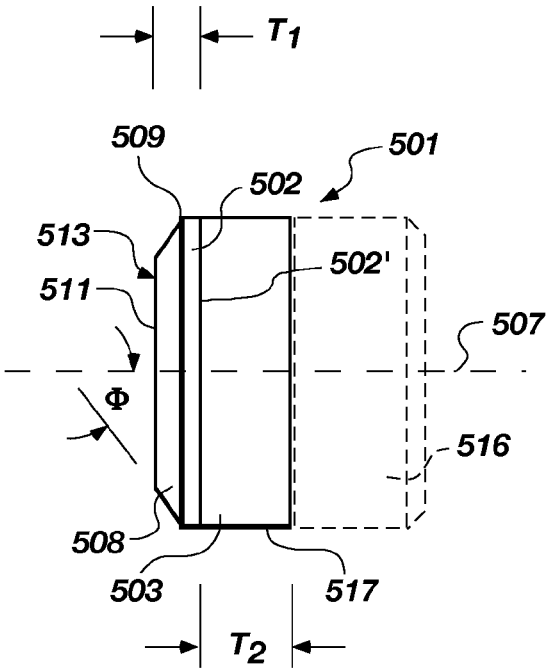
Fig. 7a (PRIOR ART)
FIG. 7*a-d* depict a prior art diamond cutter.
Figure 7B:
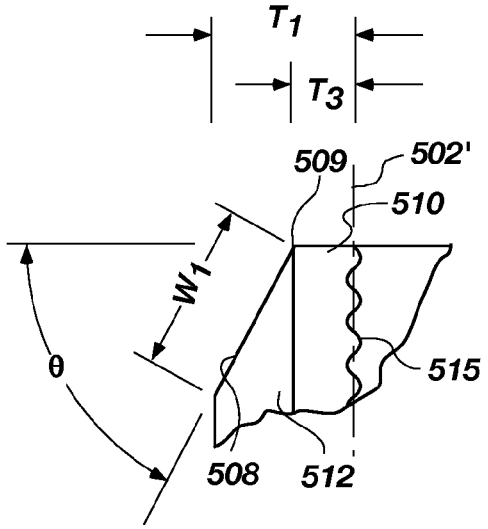
Fig. 7b (PRIOR ART)
Figure 7C:
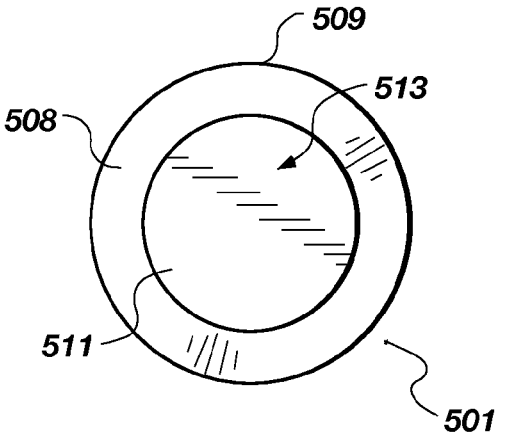
Fig. 7c (PRIOR ART)
Figure 7D:
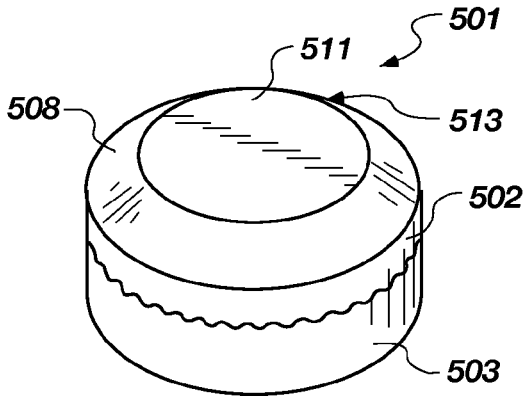
Fig. 7d (PRIOR ART)

Another optional cutter feature usable in the invention feature depicted in broken lines in FIG. 7*a* is the use of a backing cylinder 516 face-bonded to the back of substrate 503. This design permits the construction of a cutter having a greater dimension (or length) along its longitudinal axis 507 to provide additional area for bonding (as by brazing) the cutter to the bit face, and thus to enable the cutter to withstand greater forces in use without breaking free of the bit face. Such an arrangement is well known in the art, and disclosed in U.S. Pat. No. 4,200,159. However, the presence or absence of such a backing cylinder does not affect the durability or wear characteristics of the cutter.

Figure 1:
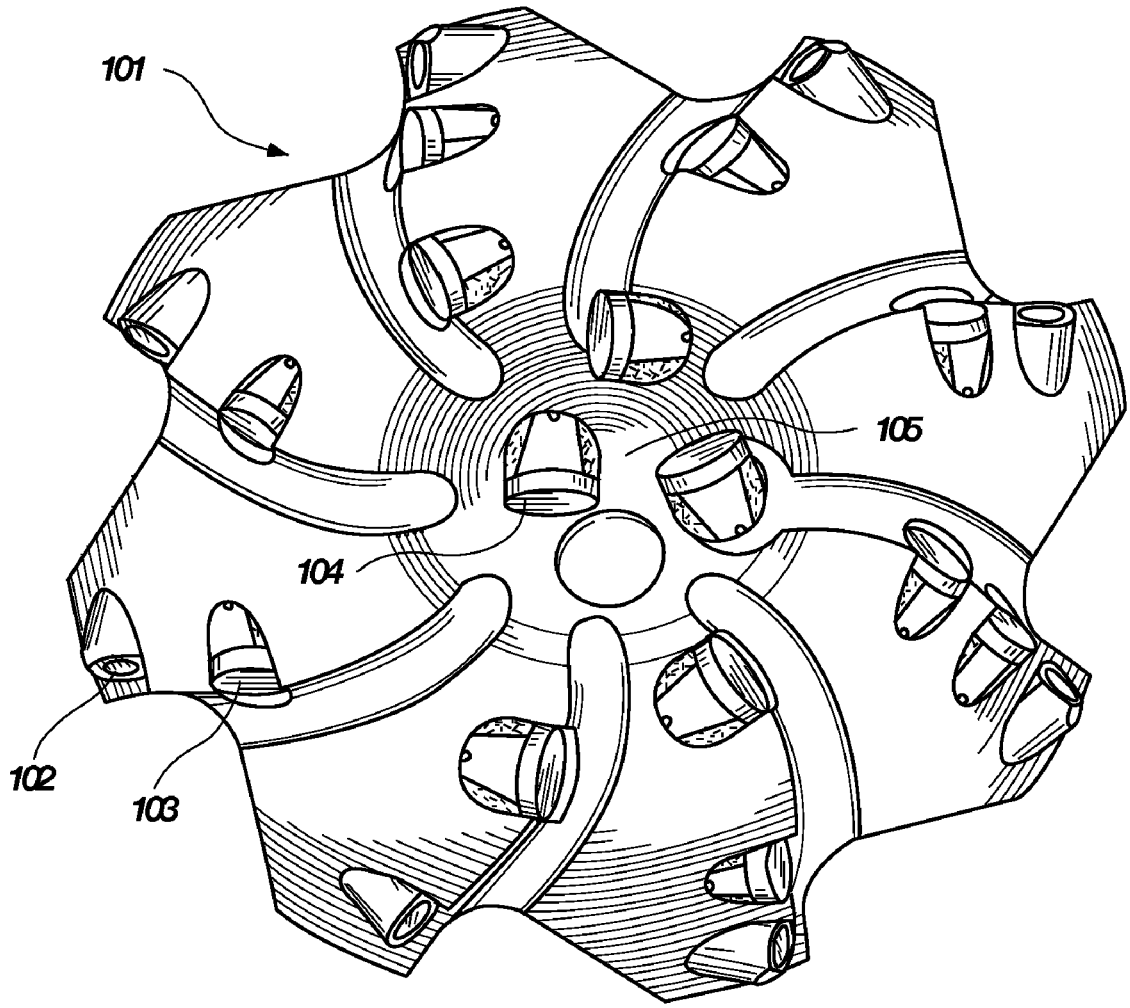
Fig. 1 (PRIOR ART)
FIG. 1 depicts a prior art drag bit.

When it is desired for the cutter 501 to have a positive rake angle or negative rake angle rather than a neutral or no rake angle when installed on a drill bit, such as the drill bit illustrated in drawing FIG. 1, the cutter 501 must be installed as the cutters 12, 14 on the drill bit 10 illustrated drawing FIG. 4. As such, the body of the drill bit 10 in drawing FIG. 4 must be designed to accommodate the desired rake, if any, for each cutter installed thereon as each cutter has the central flat area thereof parallel to the plane of the rear surface of the diamond table.

Figure 8:
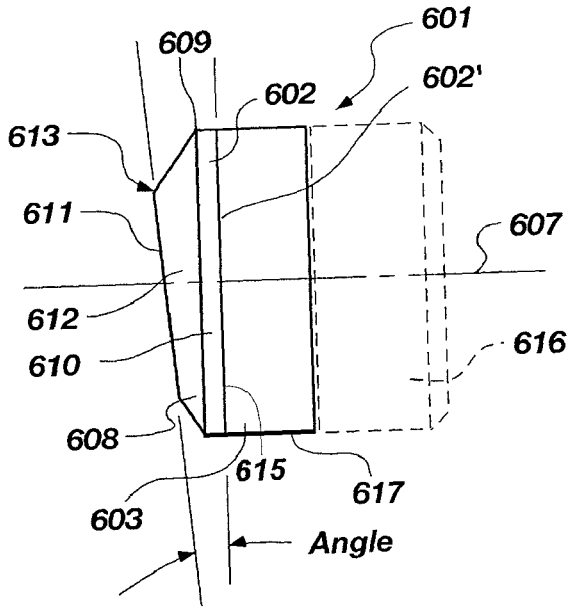
FIG. 8 depicts a first embodiment of the invention.

In contrast to the prior art, referring to drawing FIG. 8, depicted is a side view of an embodiment of the cutter 601. The cutter 601 is of a frustoconical configuration and includes a generally circular diamond layer or table 602 (e.g. polycrystalline diamond), a superabrasive material, having a back surface plane 602', a rear boundary, bonded (i.e. sintered) to a cylindrical substrate 603 (e.g. tungsten carbide). As described before, if desired, the interface between the diamond layer and the substrate may be comprised of mutually parallel ridges separated by valleys, with the ridges and valleys extending laterally across cutter 601 from side to side. Of course, many other interface geometries are known in the art and suitable for use with the invention. The diamond layer 602 includes rake land 608 with a rake land angle such as described hereinbefore relative to the side wall 606 of the diamond layer 602 (parallel to the longitudinal axis or center line 607 of the cutter 601) and extending forwardly and radially inwardly toward the longitudinal axis 607. As described hereinbefore, the dimensions of the rake land are significant to performance of the cutter. As described hereinbefore, the width of the rake land 608 should be at least about 0.050 inch, measured from the inner boundary of the rake land (or the center of the cutting face, if the rake land extends thereto) to the cutting edge along or parallel to (e.g., at the same angle) to the actual surface of the rake land. The direction of measurement, if the cutting face is circular, is generally radial but at the same angle as the rake land. It may also be desirable that the width of the rake land (or height, looking head-on at a moving cutter mounted to a bit) be equal to or greater than the design DOC.

Diamond layer 602 also includes a cutting face 613 having a flat central area 611 radially inward of rake land, and a cutting edge 609. The flat central area 611 being non-parallel to or located at an angle to, back surface 602' of diamond table 602. Between the cutting edge 609 and the substrate 603 resides a portion or depth of the diamond layer referred to as the base layer 610, while the portion or depth between the flat central area 611 of cutting face 613 and the base layer 610 is referred to as the rake land layer 612.

The central area 611 of cutting face 613, as depicted in FIG. 8 is a flat surface oriented at an angle to longitudinal axis 607 and at an angle to back surface 602' of diamond table 602. As described hereinbefore, the thickness of the diamond layer 602 is preferably in the range of 0.070 to 0.150 inch, with a most preferred range of 0.080 to 0.100 inch, although it may vary from 0.010 to 0.15 inch having sufficient impact resistance, abrasion resistance and erosion resistance in drilling of desired formations.

The base layer 610 thickness is approximately 0.050 inch as measured perpendicular to the supporting face of the substrate, parallel to axis 607 and a rake land layer 612 is approximately 0.030 to 0.050 inch thick and a rake angle of the land 608 may vary as desired. The boundary 615 of the diamond layer and substrate to the rear of the cutting edge should lie at least 0.015 inch longitudinally to the rear of the cutting edge.

The diameter of the cutter 601 depicted is approximately 0.750 inch, and the thickness of the substrate 603 is approximately 0.235 to 0.215 inch, although these two dimensions are not critical and may vary as desired.

As shown in FIG. 8, the sidewall 617 of the cutter 601 is parallel to the longitudinal axis 607 of the cutter. However, cutters need not be circular or even symmetrical in cross-section, and the cutter sidewall may not always parallel the longitudinal axis of the cutter. As described hereinbefore, the rake land angle may be set as angle θ or as angle Φ (see FIG. 7*a* or 7*b*), depending upon cutter configuration and designer preference.

Another optional but desirable feature of the embodiment depicted in FIG. 8 is the use of a low friction finish on the cutting face 613, including rake land 608. The preferred low friction finish is a polished mirror finish that has been found to reduce friction between the diamond layer 602 and the formation material being cut and to enhance the integrity of the cutting face surface.

Yet another optional feature applicable to the embodiment of FIG. 8 is the use of a small peripheral chamfer or radius at the cutting edge as taught by the prior art to increase the durability of the cutting edge while running into the borehole and at the inception of drilling, at least along the portion which initially contacts the formation. Alternately, the cutting edge may also be optionally honed in lieu of radiusing or chamfering.

Another optional cutter feature usable in the invention feature depicted in broken lines in FIG. 8 is the use of a backing cylinder 616 face-bonded to the back of substrate 603. This design permits the construction of a cutter having a greater dimension (or length) along its longitudinal axis 607 to provide additional area for bonding (as by brazing) the cutter to the bit face, and thus to enable the cutter to withstand greater forces in use without breaking free of the bit face. Such an arrangement is well known in the art, and disclosed in U.S. Pat. No. 4,200,159. However, the presence or absence of such a backing cylinder does not affect the durability or wear characteristics of the cutter.

In contrast to prior art cutters, since the cutter 601 has cutting face 613 formed at a non-perpendicular angle with respect to the longitudinal axis 607 and a non-parallel angle to the back surface 602 of the diamond table 602, the cutter 601 may be used as a cutter having either a positive rake, a neutral rake, or a negative rake when installed in a drill bit depending upon the orientation of the cutting face 613 when the cutter 601 is installed on the drill bit. In this manner, since the cutter 601 has the ability to be installed having a desired rake angle, it may be installed essentially any desired cutter location on a drill bit merely by changing the orientation of the cutting face 613 when the cutter 601 is installed on the drill bit.

Figure 8A:
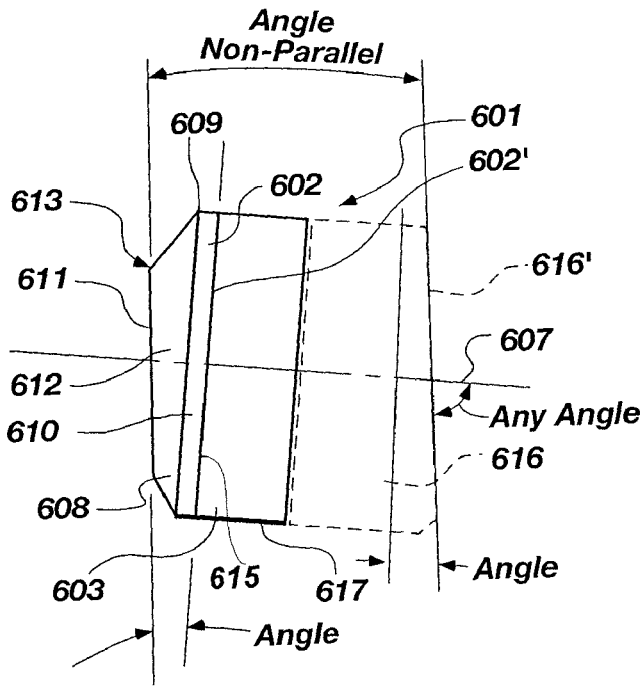
FIG. 8A depicts an alternative first embodiment of the invention.

In contrast to the prior art, referring to drawing FIG. 8A, depicted is a side view of another embodiment of the cutter 601. The cutter 601 is of a frustoconical configuration and includes a generally circular diamond layer or table 602 (e.g. polycrystalline diamond), a superabrasive material, having a back surface plane 602', a rear boundary, bonded (i.e. sintered) to a cylindrical substrate 603 (e.g. tungsten carbide). As described before, if desired, the interface between the diamond layer and the substrate may be comprised of mutually parallel ridges separated by valleys, with the ridges and valleys extending laterally across cutter 601 from side to side. Of course, many other interface geometries are known in the art and suitable for use with the invention. The diamond layer 602 includes rake land 608 with a rake land angle such as described hereinbefore relative to the side wall 606 of the diamond layer 602 (parallel to the longitudinal axis or center line 607 of the cutter 601) and extending forwardly and radially inwardly toward the longitudinal axis 607. As described hereinbefore, the dimensions of the rake land are significant to performance of the cutter. As described hereinbefore, the width of the rake land 608 should be at least about 0.050 inch, measured from the inner boundary of the rake land (or the center of the cutting face, if the rake land extends thereto) to the cutting edge along or parallel to (e.g., at the same angle) to the actual surface of the rake land. The direction of measurement, if the cutting face is circular, is generally radial but at the same angle as the rake land. It may also be desirable that the width of the rake land (or height, looking head-on at a moving cutter mounted to a bit) be equal to or greater than the design DOC.

Diamond layer 602 also includes a cutting face 613 having a flat central area 611 radially inward of rake land, and a cutting edge 609. The flat central area 611 being non-parallel to or located at an angle to, back surface 602' of diamond table 602. Between the cutting edge 609 and the substrate 603 resides a portion or depth of the diamond layer referred to as the base layer 610, while the portion or depth between the flat central area 611 of cutting face 613 and the base layer 610 is referred to as the rake land layer 612.

The central area 611 of cutting face 613, as depicted in FIG. 8A is a flat surface oriented at an angle to longitudinal axis 607 and at an angle to back surface 602' of diamond table 602. As described hereinbefore, the thickness of the diamond layer 602 is preferably in the range of 0.070 to 0.150 inch, with a most preferred range of 0.080 to 0.100 inch, although it may vary from 0.010 to 0.15 inch having sufficient impact resistance, abrasion resistance and erosion resistance in drilling of desired formations.

The base layer 610 thickness is approximately 0.050 inch as measured perpendicular to the supporting face of the substrate, parallel to axis 607 and a rake land layer 612 is approximately 0.030 to 0.050 inch thick and a rake angle of the land 608 may vary as desired. The boundary 615 of the diamond layer and substrate to the rear of the cutting edge should lie at least 0.015 inch longitudinally to the rear of the cutting edge.

The diameter of the cutter 601 depicted is approximately 0.750 inch, and the thickness of the substrate 603 is approximately 0.235 to 0.215 inch, although these two dimensions are not critical and may vary as desired.

As shown in FIG. 8A, the sidewall 617 of the cutter 601 is parallel to the longitudinal axis 607 of the cutter. However, cutters need not be circular or even symmetrical in cross-section, and the cutter sidewall may not always parallel the longitudinal axis of the cutter. As described hereinbefore, the rake land angle may be set as angle θ or as angle Φ, depending upon cutter configuration and designer preference.

Another optional but desirable feature of the embodiment depicted in FIG. 8A is the use of a low friction finish on the cutting face 613, including rake land 608. The preferred low friction finish is a polished mirror finish that has been found to reduce friction between the diamond layer 602 and the formation material being cut and to enhance the integrity of the cutting face surface.

Yet another optional feature applicable to the embodiment of FIG. 8A is the use of a small peripheral chamfer or radius at the cutting edge as taught by the prior art to increase the durability of the cutting edge while running into the borehole and at the inception of drilling, at least along the portion which initially contacts the formation. Alternately, the cutting edge may also be optionally honed in lieu of radiusing or chamfering.

Another optional cutter feature usable in the invention feature depicted in broken lines in FIG. 8A is the use of a backing cylinder 616 face-bonded to the back of substrate 603. This design permits the construction of a cutter having a greater dimension (or length) along its longitudinal axis 607 to provide additional area for bonding (as by brazing) the cutter to the bit face, and thus to enable the cutter to withstand greater forces in use without breaking free of the bit face. The backing cylinder 616 has the surface 616' formed at any angle with respect to the longitudinal axis 607. Since the surface 616' is not parallel to the longitudinal axis 607, the surface 616' is not parallel to the central area or surface 611 of the diamond layer 602. Having the surface 616' formed at an angle to the longitudinal axis 607 allows the central area or surface 611 of the diamond layer 602 to be rotated during attachment to the drag bit 101 bit to correct cutter rake angle (back rake/side rake or both). The presence or absence of such a backing cylinder does not affect the durability or wear characteristics of the cutter 601. Also, having the central area or surface 611 of the cutter 601 non-parallel to the rear surface of a cutter pocket of a drag bit 101 allows the forces acting on the cutter 601 during drilling to be better managed on the drag bit 101, particularly when the cutters 601 have little space therebetween on a blade of the drag bit 101.

In contrast to prior art cutters, since the cutter 601 has cutting face 613 formed at an angle with respect to the longitudinal axis 607 and the back surface 602' of the diamond table 602, the cutter 601 may be used as a cutter having either a positive rake, a neutral rake, or a negative rake when installed in a drill bit depending upon the orientation of the cutting face 613 when the cutter 601 is installed on the drill bit. In this manner, since the cutter 601 has the ability to be installed having a desired rake angle, it may be installed essentially any desired cutter location on a drill bit merely by changing the orientation of the cutting face 613 when the cutter 601 is installed on the drill bit.

Figure 8B:
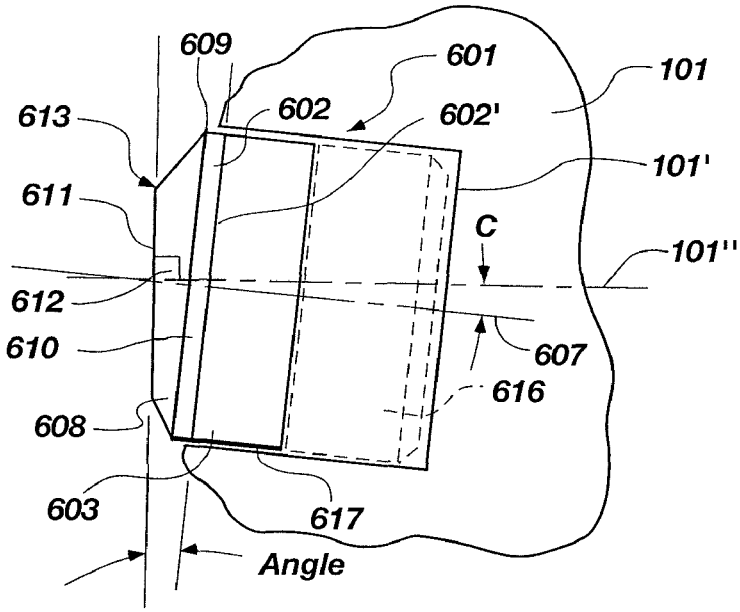
FIG. 8B depicts another alternative first embodiment of the invention.

Referring to drawing FIG. 8B, depicted is a side view of an embodiment of the cutter 601. The cutter 601 is similar to the cutter 601 illustrated in FIG. 8A and described herein with the cutter 601 installed in a cutter pocket 101' of a drag bit 101 with the longitudinal axis 607 of the cutter 601 located at an angle C with respect to the longitudinal axis 101" that is perpendicular to the surface 611 of the diamond layer 602. As shown, C is off-axis 607. The angle C may be any desired angle that allows the forces acting on the cutter 601 can be controlled and transferred to the drag bit 101 during drilling.

Figure 9:
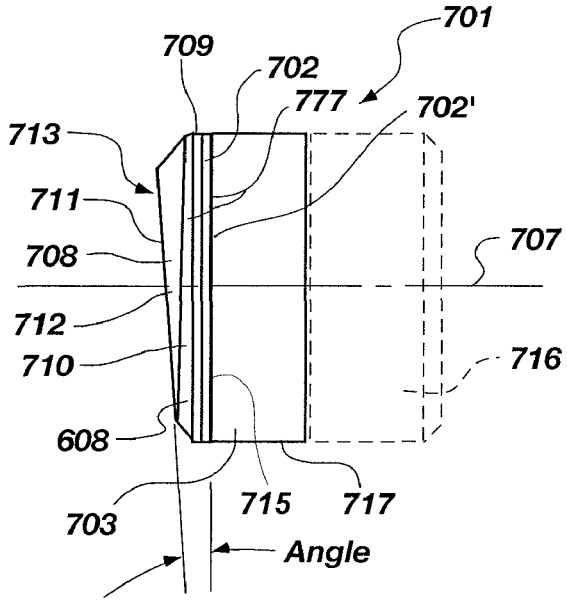
FIG. 9 depicts a second embodiment of the invention.

Referring to drawing FIG. 9, in contrast to the prior art, depicted is a side view of an embodiment of the cutter 701. The cutter 701 is of a frustoconical configuration and includes a generally circular diamond layer or table 702 (e.g., polycrystalline diamond), a superabrasive material, formed of any desired number of layers 777 formed during the diamond layer formation process during manufacture, each layer 777 having a different crystalline structure of diamond, having a back surface plane 702', a rear boundary, bonded (i.e., sintered) to a cylindrical substrate 703 (e.g., tungsten carbide). As described before, if desired, the interface between the diamond layer and the substrate may be comprised of mutually parallel ridges separated by valleys, with the ridges and valleys extending laterally across cutter 701 from side to side. Of course, many other interface geometries are known in the art and suitable for use with the invention. The diamond layer 702 includes rake land 708 with a rake land angle such as described hereinbefore relative to the side wall 706 of the diamond layer 702 (parallel to the longitudinal axis or center line 707 of the cutter 701) and extending forwardly and radially inwardly toward the longitudinal axis 707. As described hereinbefore, the dimensions of the rake land are significant to performance of the cutter. As described hereinbefore, the width of the rake land 708 should be at least about 0.050 inch, measured from the inner boundary of the rake land (or the center of the cutting face, if the rake land extends thereto) to the cutting edge along or parallel to (e.g., at the same angle) to the actual surface of the rake land. The direction of measurement, if the cutting face is circular, is generally radial but at the same angle as the rake land. It may also be desirable that the width of the rake land (or height, looking head-on at a moving cutter mounted to a bit) be equal to or greater than the design DOC.

Diamond layer 702 also includes a cutting face 713 having a generally flat central area 711 radially inward of rake land, and a cutting edge 709. The flat central area 711 being non-parallel to or located at an angle to, back surface 702' of diamond table 702. Between the cutting edge 709 and the substrate 703 resides a portion or depth of the diamond layer referred to as the base layer 710, while the portion or depth between the flat central area 711 of cutting face 713 and the base layer 710 is referred to as the rake land layer 712.

The central area 711 of cutting face 713, as depicted in FIG. 9 is a flat surface oriented at an angle to longitudinal axis 707 and at an angle to plane 702' of diamond table 702. As described hereinbefore, the thickness of the diamond layer 702 is preferably in the range of 0.070 to 0.150 inch, with a most preferred range of 0.080 to 0.100 inch, although it may vary from 0.010 to 0.15 inch having sufficient impact resistance, abrasion resistance and erosion resistance in drilling of desired formations.

The base layer 710 thickness is approximately 0.050 inch as measured perpendicular to the supporting face of the substrate, parallel to axis 707 and a rake land layer 712 is approximately 0.030 to 0.050 inch thick and a rake angle of the land 708 may vary as desired. The boundary 715 of the diamond layer and substrate to the rear of the cutting edge should lie at least 0.015 inch longitudinally to the rear of the cutting edge.

The diameter of the cutter 701 depicted is approximately 0.750 inch, and the thickness of the substrate 703 is approximately 0.235 to 0.215 inch, although these two dimensions are not critical and may vary as desired.

As shown in FIG. 9, the sidewall 717 of the cutter 701 is parallel to the longitudinal axis 707 of the cutter. However, cutters need not be circular or even symmetrical in cross-section, and the cutter sidewall may not always parallel the longitudinal axis of the cutter. As described hereinbefore, the rake land angle may be set as angle θ or as angle Φ (see FIGS. 7*a* and 7*b*), depending upon cutter configuration and designer preference.

Another optional but desirable feature of the embodiment depicted in FIG. 9 is the use of a low friction finish on the cutting face 713, including rake land 708. The preferred low friction finish is a polished mirror finish that has been found to reduce friction between the diamond layer 702 and the formation material being cut and to enhance the integrity of the cutting face surface.

Yet another optional feature applicable to the embodiment of FIG. 9 is the use of a small peripheral chamfer or radius at the cutting edge as taught by the prior art to increase the durability of the cutting edge while running into the borehole and at the inception of drilling, at least along the portion which initially contacts the formation. Alternately, the cutting edge may also be optionally honed in lieu of radiusing or chamfering.

Another optional cutter feature usable in the invention feature depicted in broken lines in FIG. 9 is the use of a backing cylinder 716 face-bonded to the back of substrate 703. This design permits the construction of a cutter having a greater dimension (or length) along its longitudinal axis 707 to provide additional area for bonding (as by brazing) the cutter to the bit face, and thus to enable the cutter to withstand greater forces in use without breaking free of the bit face. Such an arrangement is well known in the art, and disclosed in U.S. Pat. No. 4,200,159. However, the presence or absence of such a backing cylinder does not affect the durability or wear characteristics of the cutter.

In contrast to prior art cutters, since the cutter 701 has cutting face 713 formed at non-perpendicular angle with respect to the longitudinal axis 707 and non-parallel angle with respect to the plane 702' of the diamond table 702, the cutter 701 may be used as a cutter having either a positive rake, a neutral rake, or a negative rake when installed in a drill bit depending upon the orientation of the cutting face 711 when the cutter 701 is installed on the drill bit. In this manner, since the cutter 701 has the ability to be installed having a desired rake angle, it may be installed essentially any desired cutter location on a drill bit merely by changing the orientation of the cutting face 711 when the cutter 701 is installed on the drill bit.

Figure 10:
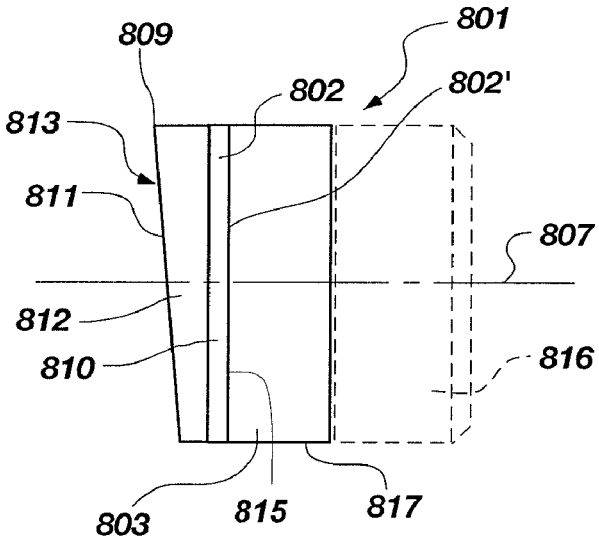
FIG. 10 depicts a third embodiment of the invention.

Referring to drawing FIG. 10, in contrast to the prior art, depicted is a side view of an embodiment of the cutter 801. The cutter 801 is of a circular wedge configuration and includes a generally circular diamond layer or table 802 (e.g., polycrystalline diamond), a superabrasive material, having a back surface plane 802', a rear boundary, bonded (i.e., sintered) to a cylindrical substrate 803 (e.g., tungsten carbide). As described before, if desired, the interface between the diamond layer and the substrate may be comprised of mutually parallel ridges separated by valleys, with the ridges and valleys extending laterally across cutter 801 from side to side. Of course, many other interface geometries are known in the art and suitable for use with the invention. The diamond layer 802 does not include a rake land with a rake land angle such as described hereinbefore relative to the side wall 806 of the diamond layer 802 (parallel to the longitudinal axis or center line 807 of the cutter 801).

Diamond layer 802 also includes a cutting face 813 having a generally flat central area 811, and a cutting edge 809. The flat central area 811 being non-parallel to, or located at an angle to, plane 802' of diamond table 802. Between the cutting edge 809 and the substrate 803 resides a portion or depth of the diamond layer referred to as the base layer 810, while the portion or depth between the flat central area 811 of cutting face 813 and the base layer 810 is referred to as the layer 812.

The area 811 of cutting face 813, as depicted in FIG. 10 is a flat surface oriented at an angle to longitudinal axis 807 and at an angle to back surface 802' of diamond table 802. As described hereinbefore, the thickness of the diamond layer 802 is preferably in the range of 0.070 to 0.150 inch, with a most preferred range of 0.080 to 0.100 inch, although it may vary from 0.010 to 0.15 inch having sufficient impact resistance, abrasion resistance and erosion resistance in drilling of desired formations.

The base layer 810 thickness is approximately 0.050 inch as measured perpendicular to the supporting face of the substrate, parallel to axis 807 and a rake land layer 812 is approximately 0.030 to 0.050 inch thick and a rake angle of the land 808 may vary as desired. The boundary 815 of the diamond layer and substrate to the rear of the cutting edge should lie at least 0.015 inch longitudinally to the rear of the cutting edge.

The diameter of the cutter 801 depicted is approximately 0.750 inch, and the thickness of the substrate 803 is approximately 0.235 to 0.215 inch, although these two dimensions are not critical and may vary as desired.

As shown in FIG. 10, the sidewall 817 of the cutter 801 is parallel to the longitudinal axis 807 of the cutter. However, cutters need not be circular or even symmetrical in cross-section, and the cutter sidewall may not always parallel the longitudinal axis of the cutter. As described hereinbefore, the rake land angle may be set as angle θ or as angle Φ (see FIGS. 7*a* and 7*b*), depending upon cutter configuration and designer preference.

Another optional but desirable feature of the embodiment depicted in FIG. 10 is the use of a low friction finish on the cutting face 811, including rake land 808. The preferred low friction finish is a polished mirror finish that has been found to reduce friction between the diamond layer 802 and the formation material being cut and to enhance the integrity of the cutting face surface.

Yet another optional feature applicable to the embodiment of FIG. 10 is the use of a small peripheral chamfer or radius at the cutting edge as taught by the prior art to increase the durability of the cutting edge while running into the borehole and at the inception of drilling, at least along the portion which initially contacts the formation. Alternately, the cutting edge may also be optionally honed in lieu of radiusing or chamfering.

Another optional cutter feature usable in the invention feature depicted in broken lines in FIG. 10 is the use of a backing cylinder 816 face-bonded to the back of substrate 803. This design permits the construction of a cutter having a greater dimension (or length) along its longitudinal axis 807 to provide additional area for bonding (as by brazing) the cutter to the bit face, and thus to enable the cutter to withstand greater forces in use without breaking free of the bit face. Such an arrangement is well known in the art, and disclosed in U.S. Pat. No. 4,200,159. However, the presence or absence of such a backing cylinder does not affect the durability or wear characteristics of the cutter.

In contrast to prior art cutters, since the cutter 801 has cutting face 813 formed at an oblique angle with respect to the longitudinal axis 807 and the plane 802' of the diamond table 802, the cutter 801 may be used as a cutter having either a positive rake, a neutral rake, or a negative rake when installed in a drill bit depending upon the orientation of the cutting face 813 when the cutter 801 is installed on the drill bit. In this manner, since the cutter 801 has the ability to be installed having a desired rake angle, it may be installed essentially any desired cutter location on a drill bit merely by changing the orientation of the cutting face 813 when the cutter 801 is installed on the drill bit.

Figure 11:
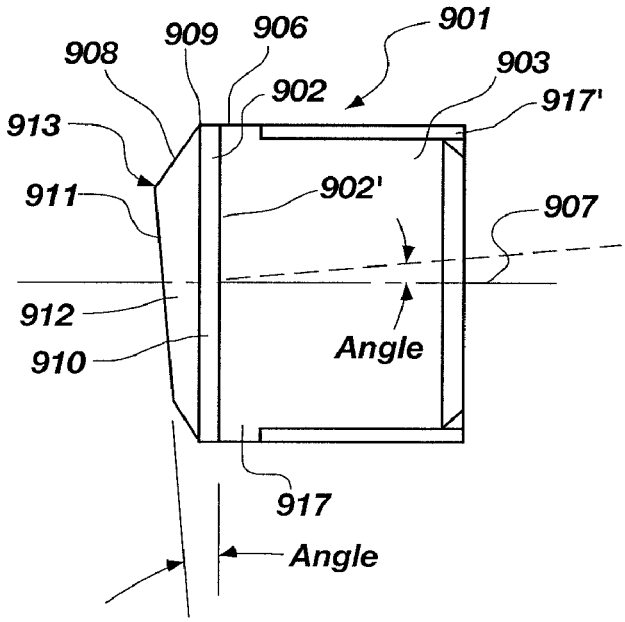
FIG. 11 depicts a fourth embodiment of the invention.

Referring to drawing FIG. 11, in contrast to the prior art, depicted is a side view of an embodiment of the cutter 901. The cutter 901 is of a frustoconical configuration and includes a generally circular diamond layer or table 902 (e.g., polycrystalline diamond), a superabrasive material, having a back surface plane 902', a rear boundary, bonded (i.e., sintered) to a cylindrical substrate 903 (e.g., tungsten carbide). As described before, if desired, the interface between the diamond layer and the substrate may be comprised of mutually parallel ridges separated by valleys, with the ridges and valleys extending laterally across cutter 901 from side to side. Of course, many other interface geometries are known in the art and suitable for use with the invention. The diamond layer 902 includes rake land 908 with a rake land angle such as described hereinbefore relative to the side wall 906 of the diamond layer 902 (parallel to the longitudinal axis or center line 907 of the cutter 901) and extending forwardly and radially inwardly toward the longitudinal axis 907. As described hereinbefore, the dimensions of the rake land are significant to performance of the cutter. As described hereinbefore, the width of the rake land 908 should be at least about 0.050 inch, measured from the inner boundary of the rake land (or the center of the cutting face, if the rake land extends thereto) to the cutting edge along or parallel to (e.g., at the same angle) to the actual surface of the rake land. The direction of measurement, if the cutting face is circular, is generally radial but at the same angle as the rake land. It may also be desirable that the width of the rake land (or height, looking head-on at a moving cutter mounted to a bit) be equal to or greater than the design DOC. Alternately, the cutter 901 may be formed without a rake land 908, such as the cutter 801 described hereinbefore.

Diamond layer 902 also includes a cutting face 913 having a generally flat central area 911 radially inward of rake land, and a cutting edge 909. The flat central area 911 being non-parallel to, or located at an angle to, back surface 902' of diamond table 902. Between the cutting edge 909 and the substrate 903 resides a portion or depth of the diamond layer referred to as the base layer 910, while the portion or depth between the flat central area 911 of cutting face 913 and the base layer 910 is referred to as the rake land layer 912.

The central area 911 of cutting face 913, as depicted in FIG. 11 is a flat surface oriented at a non-perpendicular angle to longitudinal axis 907 and at a non-parallel angle to back surface 902' of diamond table 902. As described hereinbefore, the thickness of the diamond layer 902 is preferably in the range of 0.070 to 0.150 inch, with a most preferred range of 0.080 to 0.100 inch, although it may vary from 0.010 to 0.15 inch having sufficient impact resistance, abrasion resistance and erosion resistance in drilling of desired formations.

The base layer 910 thickness is approximately 0.050 inch as measured perpendicular to the supporting face of the substrate, parallel to axis 907 and a rake land layer 912 is approximately 0.030 to 0.050 inch thick and a rake angle of the land 908 may vary as desired. The boundary of the diamond layer and substrate to the rear of the cutting edge should lie at least 0.015 inch longitudinally to the rear of the cutting edge.

The diameter of the cutter 901 depicted is approximately 0.750 inch, and the thickness of the substrate 903 is approximately 0.235 to 0.215 inch, although these two dimensions are not critical and may vary as desired.

As shown in FIG. 11, the sidewall 917 of the cutter 901 is parallel to the longitudinal axis 907 of the cutter having a reduced diameter portion located a distance from the plane 902' of the diamond table 902. The cutter 901 includes a sleeve 917' secured to the reduced diameter portion of the sidewall 917 of the cutter 901. The sleeve 917' may have the center axis thereof congruent with the axis 907 of the cutter 901 or formed at an angle with respect to the axis 907 of the cutter 902. If the center axis of the sleeve 917' is formed at an angle to the axis 907 of the cutter 901, the angle of the flat central area 911 will be increased by the angle of the central axis of the sleeve 917' when the cutter 501 is mounted in a drill bit. However, cutters need not be circular or even symmetrical in cross-section, and the cutter sidewall may not always parallel the longitudinal axis of the cutter. As described hereinbefore, the rake land angle may be set as angle θ or as angle Φ (see FIGS. 7*a* and 7*b*), depending upon cutter configuration and designer preference.

Another optional but desirable feature of the embodiment depicted in FIG. 11 is the use of a low friction finish on the cutting face 913, including rake land 908. The preferred low friction finish is a polished mirror finish that has been found to reduce friction between the diamond layer 902 and the formation material being cut and to enhance the integrity of the cutting face surface.

Yet another optional feature applicable to the embodiment of FIG. 11 is the use of a small peripheral chamfer or radius at the cutting edge as taught by the prior art to increase the durability of the cutting edge while running into the borehole and at the inception of drilling, at least along the portion which initially contacts the formation. Alternately, the cutting edge may also be optionally honed in lieu of radiusing or chamfering.

Illustrated in FIG. 11 is the use of a longer substrate 903. This design permits the construction of a cutter having a greater dimension (or length) along its longitudinal axis 907 to provide additional area for bonding (as by brazing) the cutter to the bit face, and thus to enable the cutter to withstand greater forces in use without breaking free of the bit face.

In contrast to prior art cutters, since the cutter 901 has cutting face 913 formed at an angle with respect to the longitudinal axis 907 and the backplane 902' of the diamond table 902, the cutter 901 may be used as a cutter having either a positive rake, a neutral rake, or a negative rake when installed in a drill bit depending upon the orientation of the cutting face 913 when the cutter 901 is installed on the drill bit. In this manner, since the cutter 901 has the ability to be installed having a desired rake angle, it may be installed essentially any desired cutter location on a drill bit merely by changing the orientation of the cutting face 913 when the cutter 901 is installed on the drill bit.

Figure 12:
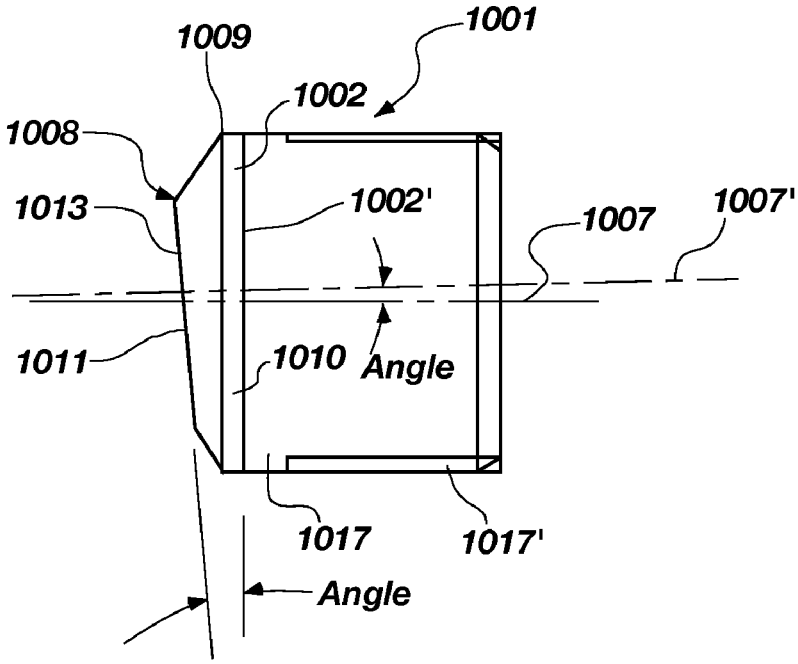
FIG. 12 depicts a fifth embodiment of the invention.

Referring to drawing FIG. 12, in contrast to the prior art, depicted is a side view of an embodiment of the cutter 1001. The cutter 1001 is of a frustoconical configuration and includes a generally circular diamond layer or table 1002 (e.g., polycrystalline diamond), a superabrasive material, having a back surface plane 1002', a rear boundary, bonded (i.e., sintered) to a cylindrical substrate 1003 (e.g., tungsten carbide). As described before, if desired, the interface between the diamond layer and the substrate may be comprised of mutually parallel ridges separated by valleys, with the ridges and valleys extending laterally across cutter 1001 from side to side. Of course, many other interface geometries are known in the art and suitable for use with the invention. The diamond layer 1002 includes rake land 1008 with a rake land angle such as described hereinbefore relative to the side wall 1006 of the diamond layer 1002 (parallel to the longitudinal axis or center line 1007 of the cutter 1001) and extending forwardly and radially inwardly toward the longitudinal axis 1007. As described hereinbefore, the dimensions of the rake land are significant to performance of the cutter. As described hereinbefore, the width of the rake land 1008 should be at least about 0.050 inch, measured from the inner boundary of the rake land (or the center of the cutting face, if the rake land extends thereto) to the cutting edge along or parallel to (e.g., at the same angle) to the actual surface of the rake land. The direction of measurement, if the cutting face is circular, is generally radial but at the same angle as the rake land. It may also be desirable that the width of the rake land (or height, looking head-on at a moving cutter mounted to a bit) be equal to or greater than the design DOC. Alternately, the cutter 1001 may be formed without a rake land 1008, such as the cutter 801 described hereinbefore.

Diamond layer 1002 also includes a cutting face 1013 having a generally flat central area 1011 radially inward of rake land, and a cutting edge 1009. The flat central area 1011 being non-parallel to, or located at an angle to, back surface plane 1002' of diamond table 1002. Between the cutting edge 1009 and the substrate 1003 resides a portion or depth of the diamond layer referred to as the base layer 1010, while the portion or depth between the flat central area 1011 of cutting face 1013 and the base layer 1010 is referred to as the rake land layer 1012.

The central area 1011 of cutting face 1013, as depicted in FIG. 12 is a flat surface oriented at an angle to longitudinal axis 1007 and at an angle to back surface plane 1002' of diamond table 1002. As described hereinbefore, the thickness of the diamond layer 1002 is preferably in the range of 0.070 to 0.150 inch, with a most preferred range of 0.080 to 0.100 inch, although it may vary from 0.010 to 0.15 inch having sufficient impact resistance, abrasion resistance and erosion resistance in drilling of desired formations.

The base layer 1010 thickness is approximately 0.050 inch as measured perpendicular to the supporting face of the substrate, parallel to axis 1007 and a rake land layer 1012 is approximately 0.030 to 0.050 inch thick and a rake angle of the land 1008 may vary as desired. The boundary of the diamond layer and substrate to the rear of the cutting edge should lie at least 0.015 inch longitudinally to the rear of the cutting edge.

The diameter of the cutter 1001 depicted is approximately 0.750 inch, and the thickness of the substrate 1003 is approximately 0.235 to 0.215 inch, although these two dimensions are not critical and may vary as desired.

As shown in FIG. 12, the sidewall 1017 of the cutter 1001 is parallel to the longitudinal axis 1007 of the cutter having a reduced diameter portion located a distance from the rear surface plane 1002' of the diamond table 1002. The cutter 1001 includes a sleeve 1017' secured to the reduced diameter portion of the sidewall 1017 of the cutter 1002. The sleeve 1017' has the center axis 1007' thereof at an angle with the axis 1007 of the cutter 1002 resulting in the sleeve 1017' having a varying wall thickness. If the center axis 1007' of the sleeve 1017' is formed at an angle to the axis 1007 of the cutter 1002, the angle of the flat central area 1011 will be increased by the angle of the central axis 1007' of the sleeve 1017' when the cutter 1002 is mounted in a drill bit. However, cutters need not be circular or even symmetrical in cross-section, and the cutter sidewall may not always parallel the longitudinal axis of the cutter. As described hereinbefore, the rake land angle may be set as angle θ or as angle Φ (see FIGS. 7*a* and 7*b*), depending upon cutter configuration and designer preference.

Another optional but desirable feature of the embodiment depicted in FIG. 12 is the use of a low friction finish on the cutting face 1013, including rake land 1008. The preferred low friction finish is a polished mirror finish that has been found to reduce friction between the diamond layer 1002 and the formation material being cut and to enhance the integrity of the cutting face surface.

Yet another optional feature applicable to the embodiment of FIG. 12 is the use of a small peripheral chamfer or radius at the cutting edge as taught by the prior art to increase the durability of the cutting edge while running into the borehole and at the inception of drilling, at least along the portion which initially contacts the formation. Alternately, the cutting edge may also be optionally honed in lieu of radiusing or chamfering.

Illustrated in FIG. 12 is the use of a longer substrate 1003. This design permits the construction of a cutter having a greater dimension (or length) along its longitudinal axis 1007 to provide additional area for bonding (as by brazing) the cutter to the bit face, and thus to enable the cutter to withstand greater forces in use without breaking free of the bit face.

In contrast to prior art cutters, since the cutter 1001 has cutting face 1013 formed at a non-perpendicular angle with respect to the longitudinal axis 1007 and a non-parallel angle with respect to the back surface plane 1002' of the diamond table 1002, the cutter 1001 may be used as a cutter having either a positive rake, a neutral rake, or a negative rake when installed in a drill bit depending upon the orientation of the cutting face 1013 when the cutter 1001 is installed on the drill bit. In this manner, since the cutter 1001 has the ability to be installed having a desired rake angle, it may be installed essentially any desired cutter location on a drill bit merely by changing the orientation of the cutting face 1013 when the cutter 1001 is installed on the drill bit.

Figure 13:
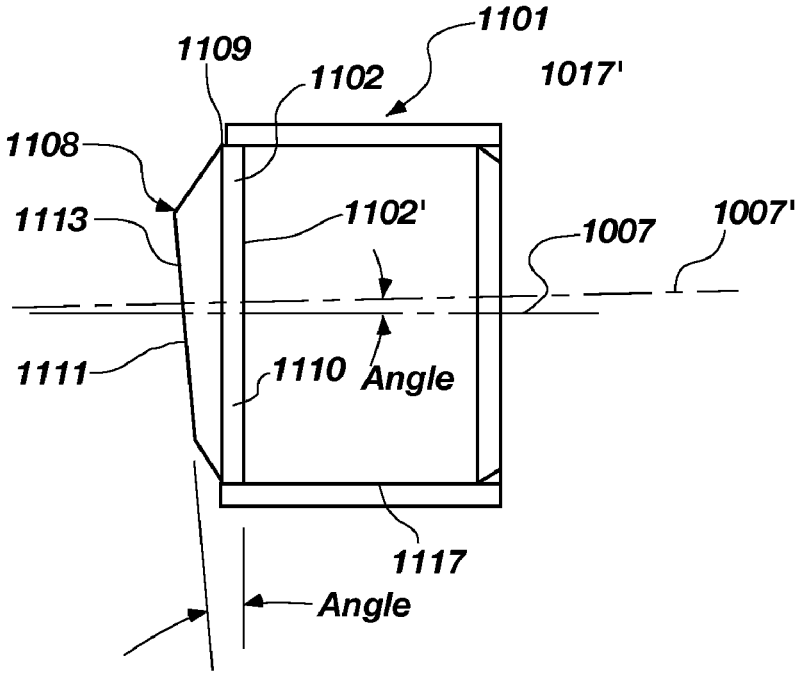
FIG. 13 depicts a sixth embodiment of the invention.

Referring to drawing FIG. 13, in contrast to the prior art, depicted is a side view of an embodiment of the cutter 1101. The cutter 1101 is of a frustoconical configuration and includes a generally circular diamond layer or table 1102 (e.g. polycrystalline diamond), a superabrasive material, having a back surface plane 1102' bonded (i.e. sintered) to a cylindrical substrate 1103 (e.g. tungsten carbide). As described before, if desired, the interface between the diamond layer and the substrate may be comprised of mutually parallel ridges separated by valleys, with the ridges and valleys extending laterally across cutter 1101 from side to side. Of course, many other interface geometries are known in the art and suitable for use with the invention. The diamond layer 1102 includes rake land 1108 with a rake land angle such as described hereinbefore relative to the side wall 1106 of the diamond layer 1102 (parallel to the longitudinal axis or center line 1107 of the cutter 1101) and extending forwardly and radially inwardly toward the longitudinal axis 1107. As described hereinbefore, the dimensions of the rake land are significant to performance of the cutter. As described hereinbefore, the width of the rake land 1108 should be at least about 0.050 inch, measured from the inner boundary of the rake land (or the center of the cutting face, if the rake land extends thereto) to the cutting edge along or parallel to (e.g., at the same angle) to the actual surface of the rake land. The direction of measurement, if the cutting face is circular, is generally radial but at the same angle as the rake land. It may also be desirable that the width of the rake land (or height, looking head-on at a moving cutter mounted to a bit) be equal to or greater than the design DOC. Alternately, the cutter 1101 may be formed without a rake land 1108, such as the cutter 801 described hereinbefore.

Diamond layer 1102 also includes a cutting face 1113 having a generally flat central area 1111 radially inward of rake land, and a cutting edge 1109. The flat central area 1111 being non-parallel to, or located at an angle to, back surface plane 1102' of diamond table 1102. Between the cutting edge 1109 and the substrate 1103 resides a portion or depth of the diamond layer referred to as the base layer 1110, while the portion or depth between the flat central area 1111 of cutting face 1113 and the base layer 1110 is referred to as the rake land layer 1112.

The central area 1111 of cutting face 1113, as depicted in FIG. 13 is a flat surface oriented at a non-perpendicular angle to longitudinal axis 1107 and at a non-parallel angle to back surface plane 1102' of diamond table 1102. As described hereinbefore, the thickness of the diamond layer 1102 is preferably in the range of 0.070 to 0.150 inch, with a most preferred range of 0.080 to 0.100 inch, although it may vary from 0.010 to 0.15 inch having sufficient impact resistance, abrasion resistance and erosion resistance in drilling of desired formations.

The base layer 1010 thickness is approximately 0.050 inch as measured perpendicular to the supporting face of the substrate, parallel to axis 1107 and a rake land layer 1112 is approximately 0.030 to 0.050 inch thick and a rake angle of the land 1108 may vary as desired. The boundary of the diamond layer and substrate to the rear of the cutting edge should lie at least 0.015 inch longitudinally to the rear of the cutting edge.

The diameter of the cutter 1101 depicted is approximately 0.750 inch, and the thickness of the substrate 1103 is approximately 0.235 to 0.215 inch, although these two dimensions are not critical and may vary as desired.

As shown in FIG. 13, the sidewall 1117 of the cutter 1101 is parallel to the longitudinal axis 1107 of the cutter 1001. The cutter 1101 includes a sleeve 1117' secured to the sidewall 1117 of the cutter 1102 having a portion thereof extending over at least a portion of the base layer 1110 of the diamond table 1102 to provide an initial metal cutting surface for the cutter 1101 when installed in a drill bit for drilling through metal objects in a well bore. The sleeve 1117' has the center axis 1107' thereof at an angle with the axis 1107 of the cutter 1102. If the center axis 1107' of the sleeve 1117' is formed at an angle to the axis 1107 of the cutter 1102, the angle of the flat central area 1111 will be increased by the angle of the central axis 1107' of the sleeve 1117' when the cutter 1102 is mounted in a drill bit. However, cutters need not be circular or even symmetrical in cross-section, and the cutter sidewall may not always parallel the longitudinal axis of the cutter. As described hereinbefore, the rake land angle may be set as angle θ or as angle Φ (see FIGS. 7*a* and 7*b*), depending upon cutter configuration and designer preference.

Another optional but desirable feature of the embodiment depicted in FIG. 13 is the use of a low friction finish on the cutting face 1113, including rake land 1108. The preferred low friction finish is a polished mirror finish that has been found to reduce friction between the diamond layer 1102 and the formation material being cut and to enhance the integrity of the cutting face surface.

Yet another optional feature applicable to the embodiment of FIG. 13 is the use of a small peripheral chamfer or radius at the cutting edge as taught by the prior art to increase the durability of the cutting edge while running into the borehole and at the inception of drilling, at least along the portion which initially contacts the formation. Alternately, the cutting edge may also be optionally honed in lieu of radiusing or chamfering.

Illustrated in FIG. 13 is the use of a longer substrate 1103. This design permits the construction of a cutter having a greater dimension (or length) along its longitudinal axis 1107 to provide additional area for bonding (as by brazing) the cutter to the bit face, and thus to enable the cutter to withstand greater forces in use without breaking free of the bit face.

In contrast to prior art cutters, since the cutter 1101 has cutting face 1113 formed at an angle with respect to the longitudinal axis 1107 and the back surface plane 1102' of the diamond table 1102, the cutter 1101 may be used as a cutter having either a positive rake, a neutral rake, or a negative rake when installed in a drill bit depending upon the orientation of the cutting face 1113 when the cutter 1101 is installed on the drill bit. In this manner, since the cutter 1101 has the ability to be installed having a desired rake angle, it may be installed essentially any desired cutter location on a drill bit merely by changing the orientation of the cutting face 1113 when the cutter 1101 is installed on the drill bit.

Figure 14:
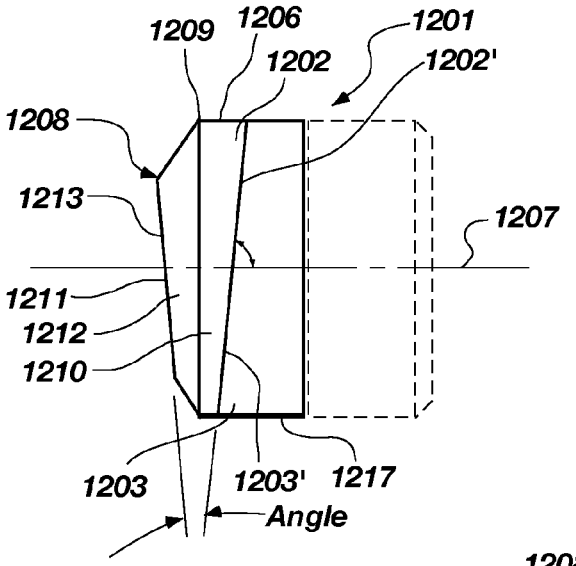
FIG. 14 depicts a seventh embodiment of the invention.

Referring to drawing FIG. 14, in contrast to the prior art, depicted is a side view of an embodiment of the cutter 1201. The cutter 1201 is of a frustoconical configuration and includes a generally circular diamond layer or table 1202 (e.g., polycrystalline diamond), a superabrasive material, having a back surface plane 1202', a rear boundary, bonded (i.e., sintered) to a cylindrical substrate 1203 (e.g., tungsten carbide) having a front surface 1203' formed at an angle with respect to the longitudinal axis 1207 of the cylindrical substrate 1203 resulting in the back surface plane 1202' being formed at an angle with respect to the longitudinal axis 1207. As described before, if desired, the interface between the diamond layer and the substrate may be comprised of mutually parallel ridges separated by valleys, with the ridges and valleys extending laterally across cutter 1201 from side to side. Of course, many other interface geometries are known in the art and suitable for use with the invention. The diamond layer 1202 includes rake land 1208 with a rake land angle such as described hereinbefore relative to the side wall 1206 of the diamond layer 1202 (parallel to the longitudinal axis or center line 1207 of the cutter 1201) and extending forwardly and radially inwardly toward the longitudinal axis 1207. As described hereinbefore, the dimensions of the rake land are significant to performance of the cutter. As described hereinbefore, the width of the rake land 1208 should be at least about 0.050 inch, measured from the inner boundary of the rake land (or the center of the cutting face, if the rake land extends thereto) to the cutting edge along or parallel to (e.g., at the same angle) to the actual surface of the rake land. The direction of measurement, if the cutting face is circular, is generally radial but at the same angle as the rake land. It may also be desirable that the width of the rake land (or height, looking head-on at a moving cutter mounted to a bit) be equal to or greater than the design DOC. Alternately, the cutter 1201 may be formed without a rake land 1208, such as the cutter 801 described hereinbefore.

Diamond layer 1202 also includes a cutting face 1213 having a generally flat central area 1211 radially inward of rake land, and a cutting edge 1209. The flat central area 1211 being non-parallel to, or located at an angle to, back surface plane 1202' of diamond table 1202 and at an angle with respect to front surface 1203' of the cylindrical substrate 1203. Between the cutting edge 1209 and the substrate 1203 resides a portion or depth of the diamond layer referred to as the base layer 1210, while the portion or depth between the flat central area 1211 of cutting face 1213 and the base layer 1210 is referred to as the rake land layer 1212.

The central area 1211 of cutting face 1213, as depicted in FIG. 14 is a flat surface oriented at an angle to longitudinal axis 1207 and at an angle to back surface 1202' of diamond table 1202. As described hereinbefore, the thickness of the diamond layer 1202 is preferably in the range of 0.070 to 0.150 inch, with a most preferred range of 0.080 to 0.100 inch, although it may vary from 0.010 to 0.15 inch having sufficient impact resistance, abrasion resistance and erosion resistance in drilling of desired formations.

The base layer 1210 thickness is approximately 0.050 inch as measured perpendicular to the supporting face of the substrate, parallel to axis 1207 and a rake land layer 1212 is approximately 0.030 to 0.050 inch thick and a rake angle of the land 1208 may vary as desired. The boundary of the diamond layer and substrate to the rear of the cutting edge should lie at least 0.015 inch longitudinally to the rear of the cutting edge.

The diameter of the cutter 1201 depicted is approximately 0.750 inch, and the thickness of the substrate 1203 is approximately 0.235 to 0.215 inch, although these two dimensions are not critical and may vary as desired.

As shown in FIG. 14, the sidewall 1217 of the cutter 1201 is parallel to the longitudinal axis 1207 of the cutter 1201. However, cutters need not be circular or even symmetrical in cross-section, and the cutter sidewall may not always parallel the longitudinal axis of the cutter. As described hereinbefore, the rake land angle may be set as angle θ or as angle Φ (see FIGS. 7*a* and 7*b*), depending upon cutter configuration and designer preference.

Another optional but desirable feature of the embodiment depicted in FIG. 14 is the use of a low friction finish on the cutting face 1213, including rake land 1208. The preferred low friction finish is a polished mirror finish that has been found to reduce friction between the diamond layer 1202 and the formation material being cut and to enhance the integrity of the cutting face surface.

Yet another optional feature applicable to the embodiment of FIG. 14 is the use of a small peripheral chamfer or radius at the cutting edge as taught by the prior art to increase the durability of the cutting edge while running into the borehole and at the inception of drilling, at least along the portion which initially contacts the formation. Alternately, the cutting edge may also be optionally honed in lieu of radiusing or chamfering.

Figure 14A:
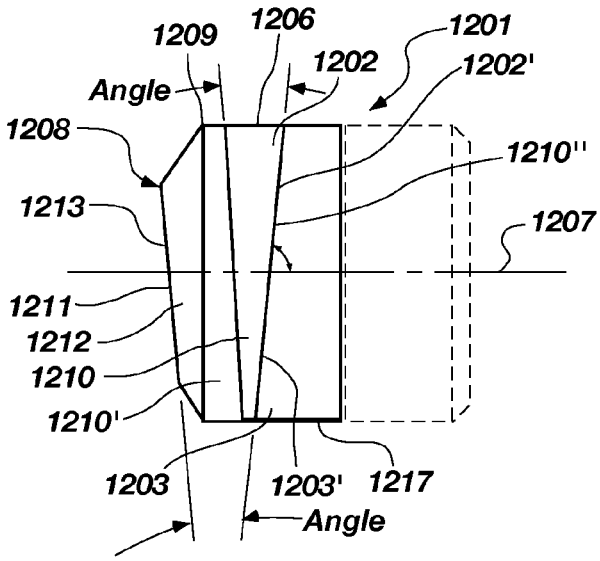
FIG. 14A depicts an alternative seventh embodiment of the invention.

Illustrated in FIG. 14A is the use of a longer substrate 1203 and non-parallel layers 1210 and 1210'. This design permits the construction of a cutter having a greater dimension (or length) along its longitudinal axis 1207 to provide additional area for bonding (as by brazing) the cutter to the bit face, and thus to enable the cutter to withstand greater forces in use without breaking free of the bit face and enable the cutting face angle to be changed with respect to the cutter body axis 1207.

In contrast to prior art cutters, since the cutter 1201 has cutting face 1213 formed at a non-perpendicular angle with respect to the longitudinal axis 1207 and a non-parallel angle with respect to the back surface 1202 of the diamond table 1202, the cutter 1201 may be used as a cutter having either a positive rake, a neutral rake, or a negative rake when installed in a drill bit depending upon the orientation of the cutting face 1213 when the cutter 1201 is installed on the drill bit. In this manner, since the cutter 1201 has the ability to be installed having a desired rake angle, it may be installed essentially any desired cutter location on a drill bit merely by changing the orientation of the cutting face 1213 when the cutter 1201 is installed on the drill bit. Referring to drawing FIG. 14A, in contrast to the prior art, depicted is a side view of an embodiment of the cutter 1201. The cutter 1201 is of a frusto-conical configuration and includes a generally circular diamond layer or table 1202 (e.g., polycrystalline diamond), a superabrasive material, having a back surface plane 1202', a rear boundary, bonded (i.e., sintered) to a cylindrical substrate 1203 (e.g., tungsten carbide) having a front surface 1203' foamed at an angle with respect to the longitudinal axis 1207 of the cylindrical substrate 1203 resulting in the back surface plane 1202' being formed at an angle with respect to the longitudinal axis 1207. As described before, if desired, the interface between the diamond layer and the substrate may be comprised of mutually parallel ridges separated by valleys, with the ridges and valleys extending laterally across cutter 1201 from side to side. Of course, many other interface geometries are known in the art and suitable for use with the invention. The diamond layer 1202 includes rake land 1208 with a rake land angle such as described hereinbefore relative to the side wall 1206 of the diamond layer 1202 (parallel to the longitudinal axis or center line 1207 of the cutter 1201) and extending forwardly and radially inwardly toward the longitudinal axis 1207. As described hereinbefore, the dimensions of the rake land are significant to performance of the cutter. As described hereinbefore, the width of the rake land 1208 should be at least about 0.050 inch, measured from the inner boundary of the rake land (or the center of the cutting face, if the rake land extends thereto) to the cutting edge along or parallel to (e.g., at the same angle) to the actual surface of the rake land. The direction of measurement, if the cutting face is circular, is generally radial but at the same angle as the rake land. It may also be desirable that the width of the rake land (or height, looking head-on at a moving cutter mounted to a bit) be equal to or greater than the design DOC. Alternately, the cutter 1201 may be formed without a rake land 1208, such as the cutter 801 described hereinbefore.

Diamond layer 1202 also includes a cutting face 1213 having a generally flat central area 1211 radially inward of rake land, and a cutting edge 1209. The flat central area 1211 being non-parallel to, or located at an angle to, back surface plane 1202' of diamond table 1202 and at an angle with respect to front surface 1203' of the cylindrical substrate 1203. Between the cutting edge 1209 and the substrate 1203 resides a portion or depth of the diamond layer referred to as the base layer 1210 and another base layer 1210' both of which are formed having non-parallel faces 1210", while the portion or depth between the flat central area 1211 of cutting face 1213 and the base layer 1210 is referred to as the rake land layer 1212.

The central area 1211 of cutting face 1213, as depicted in FIG. 14A is a flat surface oriented at an angle to longitudinal axis 1207 and at an angle to back surface 1202' of diamond table 1202. As described hereinbefore, the thickness of the diamond layer 1202 is preferably in the range of 0.070 to 0.150 inch, with a most preferred range of 0.080 to 0.100 inch, although it may vary from 0.010 to 0.15 inch having sufficient impact resistance, abrasion resistance and erosion resistance in drilling of desired formations.

The base layer 1210 thickness is approximately 0.050 inch as measured perpendicular to the supporting face of the substrate, parallel to axis 1207 and a rake land layer 1212 is approximately 0.030 to 0.050 inch thick and a rake angle of the land 1208 may vary as desired. The boundary of the diamond layer and substrate to the rear of the cutting edge should lie at least 0.015 inch longitudinally to the rear of the cutting edge.

The diameter of the cutter 1201 depicted is approximately 0.750 inch, and the thickness of the substrate 1203 is approximately 0.235 to 0.215 inch, although these two dimensions are not critical and may vary as desired.

As shown in FIG. 14A, the sidewall 1217 of the cutter 1201 is parallel to the longitudinal axis 1207 of the cutter 1201. However, cutters need not be circular or even symmetrical in cross-section, and the cutter sidewall may not always parallel the longitudinal axis of the cutter. As described hereinbefore, the rake land angle may be set as angle θ or as angle Φ (see FIGS. 7*a* and 7*b*), depending upon cutter configuration and designer preference.

Another optional but desirable feature of the embodiment depicted in FIG. 14A is the use of a low friction finish on the cutting face 1213, including rake land 1208. The preferred low friction finish is a polished mirror finish that has been found to reduce friction between the diamond layer 1202 and the formation material being cut and to enhance the integrity of the cutting face surface.

Yet another optional feature applicable to the embodiment of FIG. 14A is the use of a small peripheral chamfer or radius at the cutting edge as taught by the prior art to increase the durability of the cutting edge while running into the borehole and at the inception of drilling, at least along the portion which initially contacts the formation. Alternately, the cutting edge may also be optionally honed in lieu of radiusing or chamfering.

Illustrated in FIG. 14A is the use of a longer substrate 1203. This design permits the construction of a cutter having a greater dimension (or length) along its longitudinal axis 1207 to provide additional area for bonding (as by brazing) the cutter to the bit face, and thus to enable the cutter to withstand greater forces in use without breaking free of the bit face. Such an arrangement is well known in the art, and disclosed in U.S. Pat. No. 4,200,159. However, the presence or absence of such a backing cylinder does not affect the durability or wear characteristics of the cutter.

In contrast to prior art cutters, since the cutter 1201 has cutting face 1213 formed at a non-perpendicular angle with respect to the longitudinal axis 1207 and a non-parallel angle with respect to the back surface 1202 of the diamond table 1202, the cutter 1201 may be used as a cutter having either a positive rake, a neutral rake, or a negative rake when installed in a drill bit depending upon the orientation of the cutting face 1213 when the cutter 1201 is installed on the drill bit. In this manner, since the cutter 1201 has the ability to be installed having a desired rake angle, it may be installed essentially any desired cutter location on a drill bit merely by changing the orientation of the cutting face 1213 when the cutter 1201 is installed on the drill bit.

Figure 15:
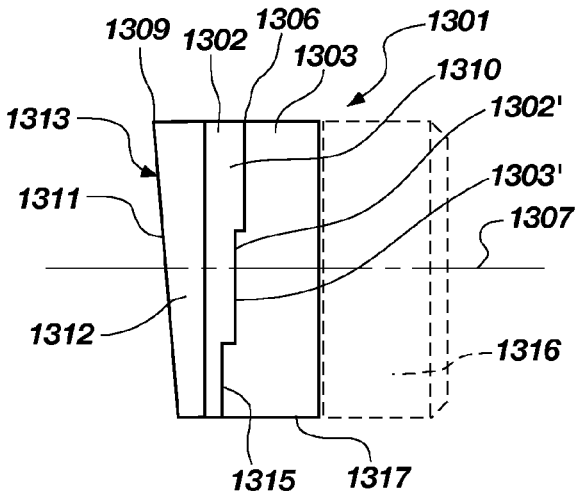
FIG. 15 depicts an eighth embodiment of the invention.

Referring to drawing FIG. 15, in contrast to the prior art, depicted is a side view of an embodiment of the cutter 1301. The cutter 1301 is of a generally circular wedge configuration and includes a circular diamond layer or table 1302 (e.g. polycrystalline diamond), a superabrasive material, having a back surface plane 1302', a rear boundary, bonded (i.e. sintered) to a cylindrical substrate 1303 (e.g. tungsten carbide) having a stepped front surface 1303'. As described before, if desired, the interface between the diamond layer and the substrate may be comprised of mutually parallel ridges separated by valleys, with the ridges and valleys extending laterally across cutter 1301 from side to side. Of course, many other interface geometries are known in the art and suitable for use with the invention. The diamond layer 1302 does not include a rake land with a rake land angle such as described hereinbefore relative to the side wall 1306 of the diamond layer 1302 (parallel to the longitudinal axis or center line 1307 of the cutter 1301).

Diamond layer 1302 also includes a cutting face 1313 having a generally flat central area 1311 radially inward of a cutting edge 1309. The flat central area 1311 being non-parallel to, or located at an angle to, back surface 1302' of diamond table 1302. Between the cutting edge 1309 and the substrate 1303 resides a portion or depth of the diamond layer referred to as the base layer 1310, while the portion or depth between the flat central area 1311 of cutting face 1313 and the base layer 1310 is referred to as the layer 1312.

The base layer 1310 thickness is approximately 0.050 inch as measured perpendicular to the supporting face of the substrate, parallel to axis 1307 and a layer 1312 is approximately 0.030 to 0.050 inch thick and may vary as desired. The boundary 1315 of the diamond layer and substrate to the rear of the cutting edge should lie at least 0.015 inch longitudinally to the rear of the cutting edge.

The diameter of the cutter 1301 depicted is approximately 0.750 inch, and the thickness of the substrate 1303 is approximately 0.235 to 0.215 inch, although these two dimensions are not critical and may vary as desired.

As shown in FIG. 15, the sidewall 1317 of the cutter 1301 is parallel to the longitudinal axis 1307 of the cutter. However, cutters need not be circular or even symmetrical in cross-section, and the cutter sidewall may not always parallel the longitudinal axis of the cutter.

Another optional but desirable feature of the embodiment depicted in FIG. 15 is the use of a low friction finish on the cutting face 1313. The preferred low friction finish is a polished mirror finish that has been found to reduce friction between the diamond layer 1302 and the formation material being cut and to enhance the integrity of the cutting face surface.

Yet another optional feature applicable to the embodiment of FIG. 15 is the use of a small peripheral chamfer or radius at the cutting edge as taught by the prior art to increase the durability of the cutting edge while running into the borehole and at the inception of drilling, at least along the portion which initially contacts the formation. Alternately, the cutting edge may also be optionally honed in lieu of radiusing or chamfering.

Another optional cutter feature usable in the invention feature depicted in broken lines in FIG. 15 is the use of a backing cylinder 1316 face-bonded to the back of substrate 1303. This design permits the construction of a cutter having a greater dimension (or length) along its longitudinal axis 1307 to provide additional area for bonding (as by brazing) the cutter to the bit face, and thus to enable the cutter to withstand greater forces in use without breaking free of the bit face. Such an arrangement is well known in the art, and disclosed in U.S. Pat. No. 4,200,159. However, the presence or absence of such a backing cylinder does not affect the durability or wear characteristics of the cutter.

In contrast to prior art cutters, since the cutter 1301 has cutting face 1313 formed at a non-perpendicular angle with respect to the longitudinal axis 1307 and a non-parallel angle with respect to the back surface 1302 of the diamond table 1302, the cutter 1301 may be used as a cutter having either a positive rake, a neutral rake, or a negative rake when installed in a drill bit depending upon the orientation of the cutting face 1313 when the cutter 1301 is installed on the drill bit. In this manner, since the cutter 1301 has the ability to be installed having a desired rake angle, it may be installed essentially any desired cutter location on a drill bit merely by changing the orientation of the cutting face 1313 when the cutter 1301 is installed on the drill bit.

Figure 16:
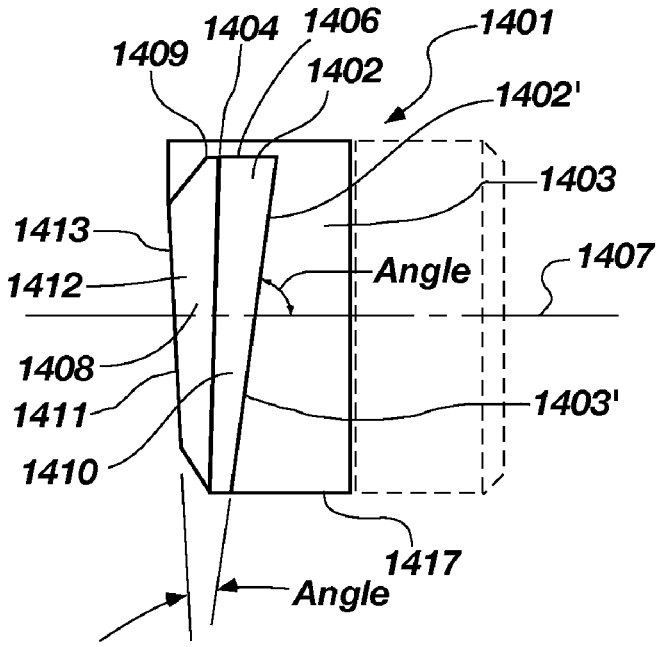
FIG. 16 depicts a ninth embodiment of the invention.

Referring to drawing FIG. 16, in contrast to the prior art, depicted is a side view of an embodiment of the cutter 1401. The cutter 1401 is of a frustoconical configuration and includes a generally circular diamond layer or table 1402 (e.g., polycrystalline diamond), a superabrasive material, having a back surface plane 1402', a rear boundary, bonded (i.e., sintered) to a cylindrical substrate 1403 (e.g., tungsten carbide) having a front surface 1403' formed at an angle with respect to the longitudinal axis 1407 of the cylindrical substrate 1403 and having a portion 1404 which covers a portion of the diamond table 1402 for the cutting of metal objects in a well bore. As described before, if desired, the interface between the diamond layer and the substrate may be comprised of mutually parallel ridges separated by valleys, with the ridges and valleys extending laterally across cutter 1401 from side to side. Of course, many other interface geometries are known in the art and suitable for use with the invention. The diamond layer 1402 includes rake land 1408 with a rake land angle such as described hereinbefore relative to the side wall 1406 of the diamond layer 1402 (parallel to the longitudinal axis or center line 1407 of the cutter 1401) and extending forwardly and radially inwardly toward the longitudinal axis 1407. As described hereinbefore, the dimensions of the rake land are significant to performance of the cutter. As described hereinbefore, the width of the rake land 1408 should be at least about 0.050 inch, measured from the inner boundary of the rake land (or the center of the cutting face, if the rake land extends thereto) to the cutting edge along or parallel to (e.g., at the same angle) to the actual surface of the rake land. The direction of measurement, if the cutting face is circular, is generally radial but at the same angle as the rake land. It may also be desirable that the width of the rake land (or height, looking head-on at a moving cutter mounted to a bit) be equal to or greater than the design DOC. Alternately, the cutter 1401 may be formed without a rake land 1408, such as the cutter 801 described hereinbefore.

Diamond layer 1402 also includes a cutting face 1413 having a generally flat central area 1411 radially inward of rake land, and a cutting edge 1409. The flat central area 1411 being non-parallel to, or located at an angle to, back surface plane 1402' of diamond table 1402 and at an angle with respect to front surface 1403' of the cylindrical substrate 1403 resulting in the back surface plane 1402' also being formed at an angle with respect to the axis 1407 of the cutter 1401. Between the cutting edge 1409 and the substrate 1403 resides a portion or depth of the diamond layer referred to as the base layer 1410, while the portion or depth between the flat central area 1411 of cutting face 1413 and the base layer 1410 is referred to as the rake land layer 1412.

The central area 1411 of cutting face 1413, as depicted in FIG. 14 is a flat surface oriented at an angle to longitudinal axis 1407 and at an angle to back surface plane 1402' of diamond table 1402. As described hereinbefore, the thickness of the diamond layer 1402 is preferably in the range of 0.070 to 0.150 inch, with a most preferred range of 0.080 to 0.100 inch, although it may vary from 0.010 to 0.15 inch having sufficient impact resistance, abrasion resistance and erosion resistance in drilling of desired formations.

The base layer 1410 thickness is approximately 0.050 inch as measured perpendicular to the supporting face of the substrate, parallel to axis 1407 and a rake land layer 1412 is approximately 0.030 to 0.050 inch thick and a rake angle of the land 1408 may vary as desired. The boundary of the diamond layer and substrate to the rear of the cutting edge should lie at least 0.015 inch longitudinally to the rear of the cutting edge.

The diameter of the cutter 1401 depicted is approximately 0.750 inch, and the thickness of the substrate 1403 is approximately 0.235 to 0.215 inch, although these two dimensions are not critical and may vary as desired.

As shown in FIG. 16, the sidewall 1417 of the cutter 1401 is parallel to the longitudinal axis 1407 of the cutter 1401. However, cutters need not be circular or even symmetrical in cross-section, and the cutter sidewall may not always parallel the longitudinal axis of the cutter. As described hereinbefore, the rake land angle may be set as angle θ or as angle Φ (see FIGS. 7*a* and 7*b*), depending upon cutter configuration and designer preference.

Another optional but desirable feature of the embodiment depicted in FIG. 14 is the use of a low friction finish on the cutting face 1413, including rake land 1408. The preferred low friction finish is a polished mirror finish that has been found to reduce friction between the diamond layer 1402 and the formation material being cut and to enhance the integrity of the cutting face surface.

Yet another optional feature applicable to the embodiment of FIG. 16 is the use of a small peripheral chamfer or radius at the cutting edge as taught by the prior art to increase the durability of the cutting edge while running into the borehole and at the inception of drilling, at least along the portion which initially contacts the formation. Alternately, the cutting edge may also be optionally honed in lieu of radiusing or chamfering.

Illustrated in FIG. 16 is the use of a longer substrate 1403 having a portion 1404 of substrate 1403 extending over a portion of the diamond table 1402 the cutter 1401 can be used to cut through metal objects in a well bore. This design permits the construction of a cutter having a greater dimension (or length) along its longitudinal axis 1607 to provide additional area for bonding (as by brazing) the cutter to the bit face, and thus to enable the cutter to withstand greater forces in use without breaking free of the bit face.

In contrast to prior art cutters, since the cutter 1401 has cutting face 1413 formed at a non-perpendicular angle with respect to the longitudinal axis 1407 and a non-parallel angle with respect to the back surface plane 1402' of the diamond table 1402, the cutter 1401 may be used as a cutter having either a positive rake, a neutral rake, or a negative rake when installed in a drill bit depending upon the orientation of the cutting face 1413 when the cutter 1401 is installed on the drill bit. In this manner, since the cutter 1401 has the ability to be installed having a desired rake angle, it may be installed essentially any desired cutter location on a drill bit merely by changing the orientation of the cutting face 1413 when the cutter 1401 is installed on the drill bit. Additionally, by having portion 1404 of substrate 1403 extending over a portion of the diamond table 1402 the cutter 1401 can be used to cut through metal objects, such as casing or cementing equipment in the casing string, in the well bore with lower risk of damage to the diamond table 1402.

Figure 17:
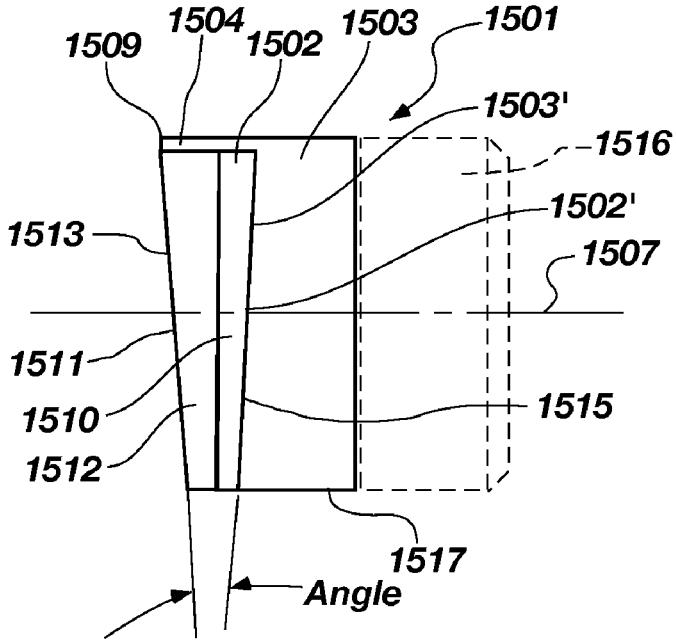
FIG. 17 depicts a tenth embodiment of the invention.

Referring to drawing FIG. 17, in contrast to the prior art, depicted is a side view of an embodiment of the cutter 1501. The cutter 1501 is of a circular wedge configuration and includes a generally circular diamond layer or table 1502 (e.g., polycrystalline diamond), a superabrasive material, having a back surface plane 1502' formed perpendicular to and at an angle to the center line 1507 of the cutter 1501 bonded (i.e., sintered) to a cylindrical substrate 1503 (e.g., tungsten carbide) having a front surface 1503' which corresponds to the angle of the back surface plane 1502', a rear boundary, of the diamond table 1502. The substrate 1503 includes a portion 1504 that extends over a portion of the diamond table 1502 for cutting metal objects in a well bore. As described before, if desired, the interface between the diamond layer and the substrate may be comprised of mutually parallel ridges separated by valleys, with the ridges and valleys extending laterally across cutter 1501 from side to side. Of course, many other interface geometries are known in the art and suitable for use with the invention. The diamond layer 1502 does not include a rake land with a rake land angle such as described hereinbefore relative to the side wall 1506 of the diamond layer 1502 (parallel to the longitudinal axis or center line 1507 of the cutter 1501).

Diamond layer 1502 also includes a generally ovoid cutting face 1513 having a flat central area 1511 radially inward of a cutting edge 1509. The flat central area 1511 being located at an angle to, back surface 1502' of diamond table 1502. Between the cutting edge 1509 and the substrate 1503 resides a portion or depth of the diamond layer referred to as the base layer 1510, while the portion or depth between the flat central area 1511 of cutting face 1513 and the base layer 1510 is referred to as the layer 1512.

The base layer 1510 thickness is approximately 0.050 inch as measured perpendicular to the supporting face of the substrate, parallel to axis 1507 and a layer 1512 is approximately 0.030 to 0.050 inch thick and may vary as desired. The boundary 1515 of the diamond layer and substrate to the rear of the cutting edge should lie at least 0.015 inch longitudinally to the rear of the cutting edge.

The diameter of the cutter 1501 depicted is approximately 0.750 inch, and the thickness of the substrate 1503 is approximately 0.235 to 0.215 inch, although these two dimensions are not critical and may vary as desired.

As shown in FIG. 17, the sidewall 1517 of the cutter 1501 is parallel to the longitudinal axis 1507 of the cutter. However, cutters need not be circular or even symmetrical in cross-section, and the cutter sidewall may not always parallel the longitudinal axis of the cutter.

Another optional but desirable feature of the embodiment depicted in FIG. 17 is the use of a low friction finish on the cutting face 1511. The preferred low friction finish is a polished mirror finish that has been found to reduce friction between the diamond layer 1502 and the formation material being cut and to enhance the integrity of the cutting face surface.

Yet another optional feature applicable to the embodiment of FIG. 17 is the use of a small peripheral chamfer or radius at the cutting edge as taught by the prior art to increase the durability of the cutting edge while running into the borehole and at the inception of drilling, at least along the portion which initially contacts the formation. Alternately, the cutting edge may also be optionally honed in lieu of radiusing or chamfering.

Another optional cutter feature usable in the invention feature depicted in broken lines in FIG. 17 is the use of a backing cylinder 1516 face-bonded to the back of substrate 1503. This design permits the construction of a cutter having a greater dimension (or length) along its longitudinal axis 1507 to provide additional area for bonding (as by brazing) the cutter to the bit face, and thus to enable the cutter to withstand greater forces in use without breaking free of the bit face. Such an arrangement is well known in the art, and disclosed in U.S. Pat. No. 4,200,159. However, the presence or absence of such a backing cylinder does not affect the durability or wear characteristics of the cutter.

In contrast to prior art cutters, since the cutter 1501 has cutting face 1513 formed at a non-perpendicular angle with respect to the longitudinal axis 1507 and a non-parallel angle with respect to the back surface plane 1502' of the diamond table 1502, the cutter 1501 may be used as a cutter having either a positive rake, a neutral rake, or a negative rake when installed in a drill bit depending upon the orientation of the cutting face 1513 when the cutter 1501 is installed on the drill bit. In this manner, since the cutter 1501 has the ability to be installed having a desired rake angle, it may be installed essentially any desired cutter location on a drill bit merely by changing the orientation of the cutting face 1511 when the cutter 1501 is installed on the drill bit. Additionally, by having portion 1504 of substrate 1503 extending over a portion of the diamond table 1502 the cutter 1501 can be used to cut through metal objects, such as casing or cementing equipment in the casing string, in the well bore with lower risk of damage to the diamond table 1502.

While the present invention has been described and illustrated in conjunction with a number of specific embodiments, those skilled in the art will appreciate that variations and modifications may be made without departing from the principles of the invention as herein illustrated, described and claimed. Cutting elements according to one or more of the disclosed embodiments may be employed in combination with cutting elements of the same or other disclosed embodiments, or with conventional cutting elements, in paired or other grouping, including but not limited to, side-by-side and leading/trailing combinations of various configurations. The present invention may be embodied in other specific forms without departing from its spirit or essential characteristics. The described embodiments are to be considered in all respects as only illustrative, and not restrictive. The scope of the invention is, therefore, indicated by the appended claims, rather than by the foregoing description. All changes that come within the meaning and range of equivalency of the claims are to be embraced within their scope.

What is claimed is:

1. A cutting element for use on a bit for drilling subterranean formations, comprising:

a volume of superabrasive material including:

a cutting face having a generally flat central area extending at a non-perpendicular angle relative to a longitudinal axis of the cutting element;

a rear boundary located aft of the cutting face;

a cutting edge at a periphery of the cutting face;

a rake land on the cutting face, wherein the flat central area of the cutting face is located radially inward of the rake land; and a sidewall between the cutting edge and the rear boundary.

2. The cutting element of claim 1, wherein the sidewall is substantially parallel to the longitudinal axis.

3. The cutting element of claim 1, wherein the volume of superabrasive material further includes two different layers of material each having a different crystalline structure.

4. The cutting element of claim 1, wherein the volume of superabrasive material is attached to a substrate element.

5. The cutting element of claim 4, wherein the substrate element includes a sleeve attached thereto.

6. The cutting element of claim 5, wherein the sleeve includes a portion thereof extending over at least a portion of the volume of superabrasive material.

7. The cutting element of claim 4, wherein a surface of the substrate element attached to the volume of superabrasive material is formed at a non-perpendicular angle with respect to the longitudinal axis of the cutting element.

8. The cutting element of claim 4, wherein the substrate element includes a portion thereof extending over a portion of the volume of superabrasive material.

* * * * *